US011122908B2

(12) United States Patent
Ribble et al.

(10) Patent No.: US 11,122,908 B2
(45) Date of Patent: Sep. 21, 2021

(54) APPARATUS FOR GRADUATED LATERAL ROTATION OF A SLEEP SURFACE

(71) Applicant: Hill-Rom Services, Inc., Batesville, IN (US)

(72) Inventors: David L. Ribble, Batesville, IN (US); Kirsten M. Emmons, Batesville, IN (US); Joshua A. Williams, West Harrison, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 329 days.

(21) Appl. No.: 16/021,796

(22) Filed: Jun. 28, 2018

(65) Prior Publication Data

US 2019/0014911 A1 Jan. 17, 2019

Related U.S. Application Data

(60) Provisional application No. 62/531,985, filed on Jul. 13, 2017.

(51) Int. Cl.
*A47C 20/12* (2006.01)
*A47C 19/02* (2006.01)
(Continued)

(52) U.S. Cl.
CPC ..... *A47C 20/12* (2013.01); *A47C 19/021* (2013.01); *A47C 20/04* (2013.01); *A47C 20/041* (2013.01);
(Continued)

(58) Field of Classification Search
CPC ..... A61G 7/008; A61G 7/001; A61G 7/015; A47C 20/04; A47C 20/041; A47C 20/042;
(Continued)

(56) References Cited

U.S. PATENT DOCUMENTS 3,775,785 A 12/1973 Mittendorf
4,754,510 A 7/1988 King
(Continued)

FOREIGN PATENT DOCUMENTS

DE 4137631 A1 5/1992
EP 262771 A1 4/1988
(Continued)

OTHER PUBLICATIONS

Adesanya, Adebola O., et al., *Perioperative Management of Obstructive Sleep Apnea,* CHEST/138/6, Dec. 2010 (10 pages).
(Continued)

*Primary Examiner* — Eric J Kurilla
*Assistant Examiner* — Amanda L Bailey
(74) *Attorney, Agent, or Firm* — Barnes & Thornburg LLP

(57) ABSTRACT

A lateral rotation apparatus includes a first adjustable frame positioned under a head segment of a person support surface and operable to rotate the head segment of the person support surface to a head tilt angle in the range of about 7 to about 30 degrees relative to a horizontal support plane. A second adjustable frame is positioned under a torso segment of a person support surface and operable to rotate the torso segment of the person support surface to a torso tilt angle that is within a range of about 5 degrees to about 10 degrees less than the head tilt angle. Each of the first adjustable frame and the second adjustable frame includes an upper frame positioned below the person support surface, and a lower frame coupled to and positioned below the upper frame. The upper frame being moveable with respect to the lower frame.

14 Claims, 15 Drawing Sheets

(51) Int. Cl.
*A61G 7/00* (2006.01)
*A61G 7/015* (2006.01)
*A61G 7/008* (2006.01)
*A47C 20/04* (2006.01)

(52) U.S. Cl.
CPC ..... *A61G 7/001* (2013.01); *A61G 7/008* (2013.01); *A61G 7/015* (2013.01)

(58) Field of Classification Search
CPC ..... A47C 20/047; A47C 20/048; A47C 20/08; A47C 20/10; A47C 20/12; A47C 20/14; A47C 20/16; A47C 20/18; A47C 19/021; A47C 19/04; A47C 19/045
See application file for complete search history.

(56) References Cited

U.S. PATENT DOCUMENTS 4,807,313 A 2/1989 Ryder et al.
5,092,007 A 3/1992 Hasty
5,097,551 A 3/1992 Smith
5,611,096 A 3/1997 Bartlett et al.
5,640,729 A * 6/1997 Marino ..... A61G 7/001 5/607
5,669,090 A * 9/1997 Basgall ..... A61G 7/002 5/611
5,745,937 A 5/1998 Weismiller et al.
5,754,998 A 5/1998 Selton
5,910,080 A 6/1999 Selton
5,966,762 A 10/1999 Wu
6,047,419 A 4/2000 Ferguson
6,081,950 A 7/2000 Selton
6,154,900 A 12/2000 Shaw
6,163,903 A 12/2000 Weismiller et al.
6,260,553 B1 * 7/2001 Mann ..... A47D 7/03 128/845
D446,676 S 8/2001 Mayes
6,370,716 B1 4/2002 Wilkinson
6,485,441 B2 11/2002 Woodward
6,536,056 B1 3/2003 Vrzalik et al.
6,578,219 B1 6/2003 Gabel et al.
6,671,907 B1 1/2004 Zuberi
6,681,424 B1 1/2004 Bourgraf et al.
6,751,817 B1 6/2004 Leach
6,904,631 B2 6/2005 Vrzalik et al.
7,007,327 B2 3/2006 Ogawa et al.
7,017,213 B2 3/2006 Chisari
7,089,615 B1 8/2006 Parimuha
D527,937 S 9/2006 Aiken et al.
7,346,945 B2 3/2008 Phillips et al.
7,418,751 B1 9/2008 Bartlett et al.
7,464,422 B2 12/2008 Townsend
7,513,003 B2 4/2009 Mossbeck
7,654,974 B2 2/2010 Bass
7,690,059 B2 4/2010 Lemire et al.
7,716,762 B2 * 5/2010 Ferraresi ..... A61G 7/0573 5/612
7,805,784 B2 10/2010 Lemire et al.
7,861,334 B2 1/2011 Lemire et al.
7,886,379 B2 2/2011 Benzo et al.
7,962,981 B2 6/2011 Lemire et al.
7,975,335 B2 7/2011 O'Keefe et al.
8,006,332 B2 8/2011 Lemire et al.
8,091,165 B2 * 1/2012 Mossbeck ..... A47C 20/041 5/620
8,220,091 B2 7/2012 Schultz
8,261,380 B2 9/2012 Ferraresi et al.
8,356,602 B2 1/2013 Crocetti
8,393,026 B2 3/2013 Dionne et al.
8,413,271 B2 4/2013 Blanchard et al.
8,544,126 B2 10/2013 Elliott et al.
8,661,586 B2 3/2014 Melcher et al.
8,689,376 B2 4/2014 Becker et al.
8,695,134 B2 4/2014 Schultz
8,701,229 B2 4/2014 Lemire et al.
8,720,447 B2 5/2014 North
8,756,736 B1 6/2014 Minson
8,789,222 B2 7/2014 Blanchard et al.
8,832,887 B2 9/2014 Mossbeck
8,844,076 B2 9/2014 Becker et al.
8,870,764 B2 10/2014 Rubin
9,038,217 B2 5/2015 Elliot et al.
9,126,571 B2 9/2015 Lemire et al.
2005/0251917 A1 * 11/2005 Wall, Sr. ..... A47C 20/041 5/618
2006/0179580 A1 8/2006 Robertson et al.
2007/0163051 A1 7/2007 Straub
2008/0109965 A1 5/2008 Mossbeck
2008/0148487 A1 6/2008 Lord et al.
2009/0094744 A1 * 4/2009 Benzo ..... A61G 7/008 5/608
2009/0250070 A1 10/2009 Pfeifer
2011/0231996 A1 9/2011 Lemire et al.
2012/0138067 A1 6/2012 Rawls-Meehan
2012/0222214 A1 9/2012 Lachenbruch et al.
2013/0198965 A1 8/2013 Melcher et al.
2013/0245395 A1 9/2013 Bidarian Moniri
2014/0059768 A1 3/2014 Lemire et al.
2014/0088373 A1 3/2014 Phillips et al.
2014/0173829 A1 6/2014 Melcher et al.
2014/0180036 A1 6/2014 Bukkapatnam et al.
2014/0245539 A1 9/2014 Ooba
2014/0259417 A1 9/2014 Nunn et al.
2014/0259418 A1 9/2014 Nunn et al.
2014/0259419 A1 9/2014 Stusynski et al.
2014/0259433 A1 9/2014 Nunn et al.
2014/0259434 A1 9/2014 Nunn et al.
2014/0266733 A1 9/2014 Hayes et al.
2014/0277611 A1 9/2014 Nunn et al.
2014/0283302 A1 9/2014 Horstmann
2014/0366274 A1 12/2014 Melcher et al.
2015/0000035 A1 1/2015 Becker et al.
2017/0277822 A1 9/2017 Clark et al.
2018/0360224 A1 * 12/2018 Cimadamore ..... A47C 20/041

FOREIGN PATENT DOCUMENTS

EP 2140847 A2 1/2010
EP 2175822 A1 4/2010
EP 2494946 A2 9/2012
JP 2011143237 A 7/2011
KR 20110083167 A 7/2011
WO 2010048310 A1 4/2010
WO 2013031504 A1 3/2013
WO WO-2013031504 A1 * 3/2013 ..... A61F 5/56
WO 2013116676 A1 8/2013
WO 2013166003 A1 11/2013
WO 2013177338 A2 11/2013
WO 2014069713 A1 5/2014
WO 2014149392 A1 9/2014
WO 2014151707 A1 9/2014
WO 2014152891 A1 9/2014

OTHER PUBLICATIONS

Ankichetty, Saravanan and Frances Chung, *Considerations for Patients with Obstructive Sleep Apnea Undergoing Ambulatory Surgery,* Current Opinion in Anesthesiology 2011, 24:605-611 (7 pages).

Arnold, Donald H., et al., *Estimation of Airway Obstruction Using Oximeter Plethysmograph Waveform Data,* Respiratory Research 2005, 6:65 (8 pages).

American Society of Anesthesiologists, Inc., *Practice Guidelines for the Perioperative Management of Patients with Obstructive Sleep Apnea,* Anesthesiology 2006, V. 104, 1081-93, No. 5, May 2006, (13 pages).

Benumof, Jonathan L., *Obstructive Sleep Apnea in the Adult Obese Patient: Implications for Airway Management,* Journal of Clinical Anesthesia 13:144-156, 2001 (13 pages).

(56) References Cited

OTHER PUBLICATIONS

Berend, Keith R., et al., *Prevalence and Management of Obstructive Sleep Apnea in Patients Undergoing Total Joint Arthroplasty,* The Journal of Arthroplasty vol. 25 No. 6 Suppl. 1 2010 (4 pages).
Berger, G., et al., *Progression of Snoring and Obstructive Sleep Apnoea: The Role of Increasing Weight and Time,* European Respiratory Journal, vol. 33, No. 2, 2009 (8 pages).
Bianchi, Matt T., *Screening for Obstructive Sleep Apnea: Bayes Weighs In,* The Open Sleep Hournal, 2009, 2, 56-59 (4 pages).
Bignold, James J., et al., *Accurate Position Monitoring and Improved Supine-Dependent Obstructive Sleep Apnea with a New Position Recording and Supine Avoidance Device,* Journal of Clinical Sleep Medicine, vol. 7, No. 4, 2001 (8 pages).
Bloom, Harrison G., et al., *Evidence-Based Recommendations for the Assessment and Management of Sleep Disorders in Older Persons,* J Am Geriatr Soc 57:761-789, 2009 (30 pages).
Bolden, Norman, et al., *Avoiding Adverse Outcomes in Patients with Obstructive Sleep Apnea (OSA): Development and Implementation of a Perioperative OSA Protocol,* Journal of Clinical Anesthesia (2009) 21, 286-293 (8 pages).
Bourne, Richard S., et al., *Clinical Review: Sleep Measurement in Critical Care Patients: Research and Clinical Implications,* Critical Care 2007, 11:226 (17 pages).
Brown, Carlos VR and George C. Velmahos, *The Consequences of Obesity on Trauma, Emergency Surgery, and Surgical Critical Care,* World Journal of Emergency Surgery 2006, 1:27 (5 pages).
Bush, Haydn, *Screening for Sleep Apnea,* American Hospital Association Health Forum, Hospital & Health Networks, hhn@omeda.com, 2013 (2 pages).
Camilo, Millene R., et al.,*Supine Sleep and Positional Sleep Apnea After Acute Ischemic Stroke and Intracerebral Hemorrhage,* Clinics 2012; 67(12); 1357-1360 (4 pages).
Carr, Gordon E., et al., *Acute Cardiopulmonary Failure From Sleep-Disordered Breathing,* Chest 2012; 141(3); 798-808 (11 pages).
Casey, Kenneth R. and Michael J. Lefor, *Management of the Hospitalized Patient with Sleep Disordered Breathing,* Current Opinion in Pulmonary Medicine 2002, 8:511-515 (5 pages).
Chia, P., et al., *The Association of Pre-Operative STOP-BANG Scores with Postoperative Critical Care Admission,* Anaesthesia 2013, 68, 950-952 (3 pages).
Choi, Jae-Kap, et al., *Effect of Jaw and Head Position on Airway Resistance in Obstructive Sleep Apnea,* Sleep and Breathing, vol. 4, No. 4, 163-168, 2000 (8 pages).
Choi, Ji Ho, et al., *Efficacy Study of a Vest-Type Device for Positional Therapy in Position Dependent Snorers,* Sleep and Biological Rhythms 2009; 7; 181-187 (7 pages).
Chung, Sharon A., et al., *A Systemic Review of Obstructive Sleep Apnea and its Implications for Anesthesiologists,* Ambulatory Anesthesiology, vol. 107, No. 5, Nov. 2008, 1543-1563 (21 pages).
Chung, F., et al., *High STOP-Band Score Indicates a High Probability of Obstructive Sleep Apnoea,* British Journal of Anaesthesia 108 (5): 768-75 (2012), (8 pages).
Chung, Frances and Babak Mokhlesi, *Postoperative Complications Associates with Obstructive Sleep Apnea: Time to Wake Up*!, Anesthesia & Analgesia, Feb. 2014, vol. 118, No. 2, 251-253 (3 pages).
Chung, Frances et al., *Preoperative Identification of Sleep Apnea Risk in Elective Surgical Patient6s, Using the Berlin Questionnaire,* Journal of Clinical Anesthesia (2007) 19, 130-134 (5 pages).
Chung, Frances and Hisham Elsaid, *Screening for Obstructive Sleep Apnea Before Surgery: Why is it Important*?, Current Opinion in Anaesthesiology 2009, 22:405-411 (7 pages).
Chung, Frances, et al., *Validation of the Berlin Questionnaire and American Society of Anesthesiologists Checklist as Screening Tools for Obstructive Sleep Apnea in Surgical Patients,* Anesthesiology, vol. 108, No. 5, May 2008, 822-830 (9 pages).
Curry, J. Paul and Lawrence A. Lynn, *Threshold Monitoring, Alarm Fatigue, and the Patterns of Unexpected Hospital Death,* The Official Journal of the Anesthesia Patient Safety Foundation, Fall 2011 (8 pages).
D'Apuzzo, Michele R. and James A. Browne, *Obstructive Sleep Apnea as a Risk Factor for Postoperative Complications After Revision Joint Arthroplasty,* The Journal of Arthroplasty, vol. 27, No. 8, Suppl. 1 (2012), 95-98 (4 pages).
der Herder, Cindy, et al., *Risks of General Anaesthesia in People with Obstructive Sleep Apnoea,* British Medical Journal, vol. 329, Oct. 23, 2004, 955-959 (5 pages).
Dolezal, Donna, et al., *Implementing Preoperative Screening of Undiagnosed Obstructive Sleep Apnea,* Journal of PeriAnesthesia Nursing, vol. 26, No. 5 (October), 2011, 338-342 (5 pages).
Ead, Heather, *Meeting the Challenge of Obstructive Sleep Apnea: Developing a Protocol that Guides Perianesthesia Patient Care,* Journal of PeriAnesthesia Nursing, vol. 24, No. 2 (April), 2009, 103-113 (11 pages).
Farney, Robert J., et al., *The STOP-Bang Equivalent Model and Prediction of Severity of Obstructive Sleep Apnea: Relation to Polysomnographic Measurements of the Apnea/Hypopnea Index,* Journal of Clinical Sleep Medicine, vol. 7, No. 5, 2011, 459-467 (9 pages).
Finkel, Kevin J., et al., *Prevalence of Undiagnosed Obstructive Sleep Apnea Among Adult Surgical Patients in an Academic Medical Center,* Sleep Medicine 10 (2009) 753-758 (6 pages).
Finucane, Thomas E., *Evidence-Based Recommendations for the Assessment and Management of Sleep Disorders in Older Persons,* JAGS, Nov. 2009, vol. 57, No. 11, 2173-2174 (3 pages).
Fletcher, Eugene C., *"Near Miss" Death in Obstructive Sleep Apnea: A Critical Care Syndrome,* Critical Care Medicine, vol. 19, No. 9, Sep. 1991, 1158-1164 (7 pages).
Galhotra, Sanjay, *Mature Rapid Response System and Potentially Avoidable Cardiopulmonary Arrests in Hospital,* Qual. Saf. Health Care 2007, 16:260-265 (6 pages).
Gammon, Brian T. and Karen F. Ricker, *An Evidence-Based Checklist for the Postoperative Management of Obstructive Sleep Apnea,* Journal of PeriAnesthesia Nursing, vol. 27, No. 5 (October) 2012, 316-322 (7 pages).
Gay, Peter C., *Sleep and Sleep-Disordered Breathing in the Hospitalized Patient, Respiratory Care,* Sep. 2010, vol. 55, No. 9, 1240-1254 (15 pages).
Gay, Peter C., *The Value of Assessing Risk of Obstructive Sleep Apnea in Surgical Patients:* It Only Takes One, Journal of Clinical Sleep Medicine, vol. 6, No. 5, 2010, 473-474 (2 pages).
Global Industry Analysts, Inc., *GIA Market Report: Sleep Apnea Diagnostic and Therapeutic Devices, A Global Strategic Business Report, MCP-3307,* Oct. 2010, www.StrategyR.com, (321 pages).
Gibson, G. J., *Obstructive Sleep Apnoea Syndrome: Underestimated and Undertreated,* British Medical Bulletin 2004; 72: 49-64 (16 pages).
Gupta, Rakesh M., et al., *Postoperative Complications in Patients With Obstructive Sleep Apnea Syndrome Undergoing Hip or Knee Replacement: A Case-Control Study,* May Clin Proc. 2001; 76:897-905 (9 pages).
Guralnick, Amy S., et al., *CPAP Adherence in Patients with Newly Diagnosed Obstructive Sleep Apnea Prior to Elective Surgery,* Journal of Clinical Sleep Medicine, vol. 8, No. 5, 2012, 501-506 (6 pages).
Heinzer, Raphael C., et al., *Positional Therapy for Obstructive Sleep Apnea: An Objective Measurement of Patients' Usage and Efficacy at Home,* Sleep Medicine 13 (2012) 425-428 (4 pages).
Hogue, Enamul, et al., *Monitoring Body Positions and Movements During Sleep Using WISPs,* Wireless Health '10, Oct. 5-7, 2010 (10 pages).
Isono, Shiroh, et al., *Lateral Position Decreases Collapsibility of the Passive Pharynx in Patients with Obstructive Sleep Apnea,* Anesthesiology, vol. 97, No. 4, Oct. 2002, 780-785 (6 pages).
Itasaka, Yoshiaki and Kazuo Ishikawa, *The Influence of Sleep Position and Obesity on Sleep Apnea,* Psychiatry and Clinical Neurosciences (2000), 54, 340-341 (3 pages).
Jensen, Candice, et al., *Postoperative CPAP and BiPAP Use Can be Safely Omitted after Laparoscopic Roux-en-Y Gastric Bypass,* Surgery for Obesity and Related Diseases 4 (2008) 512-514 (3 pages).
Joho, Shuji, et al., *Impact of Sleeping Position on Central Sleep Apnea/Cheyne-Stokes Respiration in Patients with Heart Failure,* Sleep Medicine 11 (2010) 143-148 (6 pages).

(56) References Cited

OTHER PUBLICATIONS

Jokie, Ruzica, et al., *Positional Treatment vs. Continuous Positive Airway Pressure in Patients with Positional Obstructive Sleep Apnea Syndrome,* Chest/115/3/Mar. 1999, 771-781 (11 pages).
Joosten, S.A., et al., *Obstructive Sleep Apnea Phenotypic Trait Changes from Supine to Lateral Position,* Am J Respir Crit Care Med 189; 2014; A3909 (1 page).
Joshi, Girish P., et al., *Society for Ambulatory Anesthesia Consensus Statement on Preoperative Selection of Adult Patients with Obstructive Sleep Apnea Scheduled for Ambulatory Surgery,* Anesthesia & Analgesia, Nov. 2012, vol. 115, No. 5, 1060-1068 (9 pages).
Keenan, Sean P., et al., *Clinical Practice Guidelines for the Use of Noninvasive Positive-Pressure Ventilation and Noninvasive Continuous Positive Airway Pressure in the Acute Care Setting,* Canadian Medical Association Journal, Feb. 22, 2011, 183(3) (21 pages).
Khayat, Rami, et al., *In-Hospital Resting for Sleep-Disordered Breathing in Hospitalized Patients with Decompensated Heart Failure: Report of Prevalence and Patient Characteristics, Journal of Cardiac Failure,* vol. 15, No. 9 (2009) (739-746).
Kim, Eun Joong, *The Prevalence and Characteristics of Positional Sleep Apnea in Korea,* Korean J Otorhinolaryngol-Head Neck Surg. 2009:52:407-12 (6 pages).
Kulkarni, Gaurav V., et al., *Obstructive Sleep Apnea in General Surgery Patients: Is it More Common than we Think?*, The American Journal of Surgery (2014) 207, 436-440 (5 pages).
Lakdawala, Linda, *Creating a Safer Perioperative Environment With an Obstructive Sleep Apnea Screening Tool,* Journal of PeriAnesthesia Nursing, vol. 26, No. 1 (February) 2001, 15-24 (10 pages).
Lee, Chul Hee, et al., *Changes in Site of Obstruction in Obstructive Sleep Apnea Patients According to Sleep Position: A DISE Study,* Laryngoscope 00: Month 2014 (7 pages).
Lee, Jung Bok, et al., *Determining Optimal Sleep Position in Patients with Positional Sleep-Disordered Breathing Using Response Surface Analysis,* J. Sleep Res. (2009) 18, 26-35 (10 pages).
Lockhart, Ellen M., et al. *Obstructive Sleep Apnea Screening and Postoperative Mortality in a Large Surgical Cohort,* Sleep Medicine 14 (2013) 407-415 (9 pages).
Lynn, Lawrence A. and J. Paul Curry, *Patterns of Unexpected In-Hospital Deaths: A Root Cause Analysis,* Patient Safety in Surgery 2011, 5:3 (25 pages).
Mador, M. Jeffrey, et al., *Are the Adverse Effects of Body Position in Patients with Obstructive Sleep Apnea Dependent on Sleep Stage?*, Sleep Breath (2010) 14:13-17 (7 pages).
Mador, M. Jeffrey, et al., *Prevalence of Positional Sleep Apnea in Patients Undergoing Polysomnography,* Chest 2005; 128:2130-2137 (8 pages).
Marcus, Howard, *Obesity and Postoperative Surgical Risk,* The Doctors Company, Third Quarter 2010, 1-8 (8 pages).
Martin-Du Pan, Rémy, et al., *The Role of Body Position and Gravity in the Symptoms and Treatment of Various Medical Diseases,* Swiss Med. Wkly. 2004: 134:543-551 (10 pages).
Memtsoudis, Stavros G., et al., *A Rude Awakening—The Perioperative Sleep Apnea Epidemic,* N Engl. J. Med. 368:25, 2352-2353 (Jun. 20, 2013) (2 pages).
Menon, Akshay and Manoj Kumar, *Influence of Body Position on Severity of Obstructive Sleep Apnea: A Systematic Review,* Otolaryngology, vol. 2013, Article ID 670381 (2013) (8 pages).
Mininni, Nicolette C., et al., *Pulse Oximetry: An Essential Tool for the Busy Med-Surg Nurse,* American Nurse Today, Nov./Dec. 2009, 31-33 (3 pages).
Mokhlesi, Babak, *Empiric Postoperative Autotitrating Positive Airway Pressure Therapy / Generating Evidence in the Perioperative Care of Patients at Risk for Obstructive Sleep Apnea,* Chest 144/1 (Jul. 2013) 5-7 (3 pages).
Mull, Yvonne and Marshall Bedder, *Obstructive Sleep Apnea Syndrome in Ambulatory Surgical Patients,* AORN Journal, vol. 76, No. 3, 458-462 (Sep. 2002) (5 pages).
Nader, Nizar Z., et al., *Newly Identified Obstructive Sleep Apnea in Hospitalized Patients: Analysis of an Evaluation and Treatment Strategy,* Journal of Sleep Medicine, vol. 2, No. 4, 2006, 431-437 (7 Pages).
Pevernagie, Dirk A., et al., *Effects of Body Position on the Upper Airway of Patients with Obstructive Sleep Apnea,* Am J Respir Crit Care Med, vol. 152, 179-185, 1995 (7 pages).
Qureshi, Asher and Robert D. Ballard, *Obstructive Sleep Apnea,* J Allergy Clin Immunol, vol. 112, No. 4, 643-651 (2003) (9 pages).
Richard, Wietske, et al., *The Role of Sleep Position in Obstructive Sleep Apnea Syndrome,* Eur Arch Otorhinolaryngol (2006) 263:946-950 (5 pages).
Rocke, Daniel, et al., *Effectiveness of a Postoperative Disposition Protocol for Sleep Apnea Surgery,* American Journal of Otolaryngology—Head and Neck Medicine and Surgery 34 (2013) 273-277 (5 pages).
Gabbott, D.A., *The Effect of Single-Handed Cricoid Pressure on Neck Movement After Applying Manual In-Line Stabilisation,* Anaesthesia, 1997, 52, 586-602 (17 pages).
Ross, Jacqueline, *Obstructive Sleep Apnea: Knowledge to Improve Patient Outcomes,* Journal of PeriAnesthesia Nursing, vol. 23, No. 4 (August), 2008, 273-275 (3 pages).
Setaro, Jill, *Obstructive Sleep Apnea: A Standard of Care That Works, Journal of PeriAnesthesia Nursing,* vol. 27, No. 5 (October), 2012, 323-328 (6 pages).
Sheldon, Alison, et al., *Nursing Assessment of Obstructive Sleep Apnea in Hospitalised Adults: A Review of Risk Factors and Screening Tools,* Contemporary Nurse, vol. 34, Issue 1, Dec. 2009/Jan. 2010, 19-33 (16 pages).
Skinner, Margot A., et al., *Efficacy of the 'Tennis Ball Technique' Versus nCPAP in the Management of Position-Dependent Obstructive Sleep Apnoea Syndrome,* Respirology (2008) 13, 708-715 (8 pages).
Stearns, Joshua D. and Tracey L. Stierer, *Peri-Operative Identification of Patients at Risk for Obstructive Sleep Apnea,* Seminars in Anesthesia, Perioperative Medicine and Pain (2007) 26, 73-82 (10 pages).
van Kesteren, Ellen R., et al., *Quantitative Effects of Trunk and Head Position on the Apnea Hypopnea Index in Obstructive Sleep Apnea,* Sleep, vol. 34, No. 8 (2011), 1075-1081 (7 pages).
Veasey, Sigrid C., et al., *Medical Therapy for Obstructive Sleep Apnea: A Review by the Medical Therapy for Obstructive Sleep Apnea Task Force of the Standards of Practice Committee of the American Academy of Sleep Medicine,* Sleep, vol. 29, No. 8 (2006), 1036-1044 (9 pages).
Wolfson, Alexander, et al., *Postoperative Analgesia for Patients with Obstructive Sleep Apnea Syndrome,* Seminars in Anesthesia, Perioperative Medicine and Pain (2007), 26, 103-109 (7 pages).
Yantis, Mary Ann, *Decreasing Surgical Risks for Patients with Obstructive Sleep Apnea,* AORN Journal, vol. 68, No. 1 (Jul. 1998), 50-55 (6 pages).
Ravesloot, M.J.L., and N. de Vries, *Reliable Calculation of the Efficacy of Non-Surgical Treatment of Obstructive Sleep Apnea Revisted,* Sleep, vol. 34, No. 1 (2011), 105-110 (6 pages).
Moon, Il Joon, et al., *Sleep Magnetic Resonance Imagine as a New Diagnostic Method in Obstructive Sleep Apnea Syndrome,* Laryngoscope 120: Dec. 2010, 2546-2554 (9 pages).
Nepomnayshy, Dmitry, et al., *Sleep Apnea: Is Routine Preoperative Screening Necessary?*, Obes Surg (2013) 23:287-192 (5 pages).
Press Release: *World's Leading Health Media Promotes Disinformation on Best Sleeping Positions* (Sep. 22, 2010), Sleeping Positions Research Summary (24 Studies), http://www.normalbreathing.com/1-6-best-sleep-positions.php (14 pages).
Oksenberg, Arie, et al., *Association of Body Position with Severity of Apneic Events in Patients with Severe Nonpositional Obstructive Sleep Apnea,* Chest 2000; 118; 1018-1024 (9 pages).
Oksenberg, Arie, *The Avoidance of the Supine Posture during Sleep for Patients with Supine-related Sleep Apnea,* BSM Protocols for Adherence and Treatment of Intrinsic Sleep Disorders, Chapter 23, 223-236 (14 pages).

(56) References Cited

OTHER PUBLICATIONS

Oksenberg, Arie and Donald Silverberg, *The Effect of Body Posture on Sleep-Related Breathing Disorders: Facts and Therapeutic Implications,* Sleep Medicine Reviews, vol. 2, No. 3, 139-162 (1998) (25 pages).
Oksenberg, Arie, et al., *Positional Therapy for Obstructive Sleep Apnea Patients: A 6-Month Follow-Up Study,* Laryngoscope 116, Nov. 2006, 1995-2000 (6 pages).
Oksenberg, Arie, et al., *REM-Related Obstructive Sleep Apnea: The Effect of Body Position,* Journal of Clinical Sleep Medicine, vol. 6, No. 4 (2010), 343-348 (6 pages).
Ozeke, Ozcan, et al., *Influence of the Right- Versus Left-Sided Sleeping Position on the Apnea-Hypopnea Index in Patients with Sleep Apnea,* Sleep Breath, published online Jun. 16, 2011 (5 pages).
Ozeke, Ozcan, et al., *Sleep Apnea, Heart Failure, and Sleep Position,* Sleep Breath, published online Nov. 9, 2011 (4 pages).
Permut, Irene, et al., *Comparison of Positional Therapy to CPAP in Patients with Positional Obstructive Sleep Apnea,* Journal of Clinical Sleep Medicine, vol. 6, No. 3 (2010), 238-243 (6 pages).
Author Unknown, *Positioning of Surgical Patients With Sleep Apnea,* ClinicalTrials.gov, http://clinicaltrials.gov/ct2/show/NCT02123238?term-apnea+and+position&rank=3 (2014) (5 pages).
Author Unknown, *Obstructive Sleep Apnea May Block the Path to a Positive Postoperative Outcome,* 2007 Pennsylvania Patient Safety Authority, reprinted from the PA-PSRS Patient Safety Advisory, vol. 4, No. 3 (Sep. 2007) (9 pages).
Proczko, Monika, et al., *STOP-Bang and the Effect on Patient Outcome and Length of Hospital Stay when Patients are not Using Continuous Positive Airway Pressure,* J Anesth, published online May 29, 2014 (7 pages).
Ramachandran, Satya Krishna, et al., *Derivation and Validation of a Simple Perioperative Sleep Apnea Prediction Score,* Society for Ambulatory Anesthesiology, vol. 110, No. 4 (Apr. 2010), 1007-1015 (9 pages).
Ravesloot, M.J.L. and N. de Vries, *Calculation of Surgical and Non-Surgical Efficacy for OSA / Reliable Calculation of the Efficacy of Non-Surgical and Surgical Treatment of Obstructive Sleep Apnea Revisted,* vol. 34, Issue 01 (2001) 105-110 (2 pages).
Ravesloot, M.J.L., et al., *The Undervalued Potential of Positional Therapy in Position-Dependent Snoring and Obstructive Sleep Apnea—A Review of the Literature,* Sleep Breath, published online Mar. 24, 2012 (11 pages).
Ravesloot, Madeline J.L., et al., *Treatment Adherence Should be Taken into Account when Reporting Treatment Outcomes in Obstructive Sleep Apnea,* Sleep Medicine, vol. 124, Issue 1 (Jan. 2014) 344-345 (3 pages).
Richardson, Annette and Anne Killen, *How Long do Patients Spend Weaning from CPAP in Critical Care?,* Intensive and Critical Care Nursing (2006) 22, 206-213 (8 pages).
Rosenberg, Russell and Paul Doghramji, *Optimal Treatment of Obstructive Sleep Apnea and Excessive Sleepiness,* Springer Healthcare Communication, published online Apr. 3, 2009, 295-312 (18 pages).
Rosenthal, Leon, *Got CPAP? Use it in the Hospital!*, Sleep Breath, published online Nov. 25, 2011 (4 pages).
Safiruddin, Faiza, et al., *Analysis of the Influence of Head Rotation During Drug-Induced Sleep Endoscopy in Obstructive Sleep Apnea,* Laryngoscope 124: Sep. 2014, 2195-2199 (5 pages).
Seet, Edwin and Frances Chung, *Obstructive Sleep Apnea: Preoperative Assessment,* Anesthesiology Clin 28 (2010) 199-215 (17 pages).
Seet, Edwin, et al., *Perioperative Clinical Pathways to Manage Sleep-Disordered Breathing,* Sleep Med Clin 8 (2013) 105-120 (16 pages).
Sforza, Emilia, et al., *A 3-Year Longitudinal Study of Sleep Disordered Breathing in the Elderly,* European Respiratory Journal, vol. 40, No. 3 (2012) 665-672 (8 pages).
Sforza, E., et al., *Natural Evolution of Sleep Apnoea Syndrome: A Five Year Longitudinal Study,* European Respiratory Journal, 1994, 7, 1765-1770 (6 pages).
Shafazand, Shirin, *Perioperative Management of Obstructive Sleep Apnea: Ready for Prime Time?*, Cleveland Clinic Journal of Medicine, vol. 76, Supp. 4, Nov. 2009 (6 pages).
Siddiqui, Fouzia, et al. *Half of Patients with Obstructive Sleep Apnea have a Higher NREM AHI than REM AHI,* Sleep Medicine 7 (2006) 281-285 (5 pages).
Singh, M., et al., *Proportion of Surgical Patients with Undiagnosed Obstructive Sleep Apnoea,* British Journal of Anaesthesia 110 (4); 629-636 (2013) (8 pages).
Skinner, Margot A., et al., *Elevated Posture for the Management of Obstructive Sleep Apnea,* Sleep and Breathing, vol. 8, No. 4 (2004) 193-200 (10 pages).
Author Unknown, *There's More than One Way to Improve Nightime Breathing,* European Sleep Works, http://www.sleepworks.com/resource/medical-needs/sleep-apnea (2014) (3 pages).
Park, Steven V., *Sleep Apnea CPAP Compliance Craziness,* Doctor Steven Y_ Park, MD New York, NY Integrative Solutions for Obstructive Sleep Apnea, Upper Airway Resistance Syndrome, and Snoring (Nov. 10, 2009) (7 pages).
Monk, Timothy H., et al., *Measuring Sleep Habits Without Using a Diary: The Sleep Timing Questionnaire,* Sleep, vol. 26, No. 2 (2003) 208-212 (5 pages).
Sorscher, Adam J. and Evan M. Caruso, *Frequency of Provision of CPAP in the Inpatient Setting: An Observational Study,* Sleep Breath, published online Nov. 23, 2011 (6 pages).
Spurr, Kathy F., et al., *Prevalence of Unspecified Sleep Apnea and the use of Continuous Positive Airway Pressure in Hospitalized Patients, 2004 National Hospital Discharge Survey,* Sleep Breath (2008) 12:229-234 (8 pages).
Srijithesh PR, et al., *Positional Therapy for Obstructive Sleep Apnoea (Protocol)*, The Cochrane Library 2014, Issue 2 (11 pages).
Sundar, Eswar, et al., *Perioperative Screening for the Management of Patients with Obstructive Sleep Apnea,* JCOM, vol. 18, No. 9, Sep. 2011, 399-411 (13 pages).
Szollosi, Irene, et al., *Lateral Sleeping Position Reduces Severity of Central Sleep Apnea/Cheyne-Stokes Respiration,* Sleep, vol. 29, No. 8 (2006), 1045-1051 (7 pages).
Author Unknown, *A Promising Concept of Combination Therapy for Positional Obstructive Sleep Apnea,* Springer Link, http://link.springer.com/article/10.1007/s11325-014-1068-8, Oct. 2014 (4 pages).
Author Unknown, *Upper Airway Collapse During Drug Induced Sleep Endoscopy: Head Rotation in Supine Position Compared with Lateral Head and Truck Position,* Springer Link, http://link.springer.com/article/10.1007/s00405-014-3215-z, Aug. 2014 (4 pages).
Vasu, Tajender S., et al., *Obstructive Sleep Apnea Syndrome and Postoperative Complications,* Arch Otolaryngol Head Neck Surg, vol. 136, No. 10, Oct. 2010 (5 pages).
Matthews, Dan, Mattresses—*A Futile Weapon in the Fight Against Sleep Apnea,* http://www.danmatthewsdds.com/mattresses-%E2%80%93-futile-weapon-fight-sleep-apnea/ (2014) (1 page).
Marks, Steve, *Hospital Care of Patients with Sleep Apnea,* Areté Sleep Health, last modified on May 16, 2013 (63 pages).
Carlisle, Heather, *The Case for Capnography in Patients Receiving Opioids,* American Nurse Today, vol. 9, No. 9 (Sep. 2014) 22-27 (69 pages).
Gold, Jenny, *The Sleep Apnea Business is Booming, and Insurers Aren't Happy,* NPR_ApnesvsInsurers.mht, (Jan. 16, 2012) (3 page).
Author unknown, *Sleep right, Sleep tight, Natural sleep before medicines, Sleep Diary,* www.nps.org.au/sleep, last modified Jul. 7, 2010 (4 pages).
Quan, S. F., *Evolution of OSA,* Thorax 1998; 53:532 (4 pages).
Maurer, J. T., et al., *Treatment of Obstructive Sleep Apnea with a New Vest Preventing the Supine Position,* Thieme-Connect (2003) (1 page).
Schreuder, K.E., *The Effect of Cervical Positioning on Benign Snoring by Means of a Custom-Fitted Pillow,* Centre for Sleep and Wake Disorders Kempenhaeghe, 5591 VE HEEZE, the Netherlands, last modified Dec. 1, 2011 (4 pages).
Chung, Frances, *Semi-up Right Position Study,* Clinical Trials.gov, last updated May 28, 2014 (5 pages).

(56) References Cited

OTHER PUBLICATIONS

Author Unknown, *National Sleep Foundation Sleep Diary,* National Sleep Foundation, last modified Apr. 18, 2003 (2 pages).
Takaoka, Shanon, CPAP Adherence, Is it too much "pressure"?, Feb. 7, 2007 (41 pages).
Seren, Suaf, *The Effect of Pure Prone Positioning Therapy for the Patients With Mild to Moderate Obstructive Sleep Apnea,* ClinicalTrials.gov, last updated Jun. 7, 2011 (4 pages).
Jackman, Shawn M. and Bruce Hubbert, *Riding the Wireless Wave* (*without wiping out*), HIMSS12 Annual Conference & Exhibition, last modified Feb. 20, 2012 (133 pages).
de Vries, Nico and Madeline Ravesloot, *Apnea Calculator,* http://apneacalculator.com (2014) (2 pages).
Oexman, Robert, *Can a Mattress Really Impact Your Sleep*?, Huffpost Healthy Living, Posted Oct. 14, 2012, 10:00 a.m. (8 pages).
Palmer, Laura and Suzanne R. Morrison, *Obesity and Obstructive Sleep Apnea / Is there a limit for ambulatory surgery*?, OR Nurse Journal, Sep. 2014 (9 pages).
Oksenberg, Arie, *Are We Missing a Simple Treatment for Most Adults Sleep Apnea Patients? The Avoidance of the Supine Sleep Position,* ResearchGate.net, Aug. 12, 2014 (2 pages).
Author Unknown, *Obstructive Sleep Apnea* (*OSA*), *Care of Adult Patients,* St. Anthony Central Hospital Clinical Standards, Jul. 8, 2009 (9 pages).
Gross, Jeffrey B., *Practice Guidelines for the Perioperative Management of Patients with Obstructive Sleep Apnea: An Updated Report by the American Society of Anesthesiologists Task Force on Perioperative Management of Patients with Obstructive Sleep Apnea,* U.S. Department of Health & Human Services, updated on May 9, 2014 (13 pages).
O'Connor, Anahad, *Treating Sleep Apnea Without the Mask,* NYTimes.com, Apr. 9, 2012 (7 pages).
Stradling, J. R. and R. J. O. Davies, *Sleep 1: Obstructive Sleep Apnea/Hypopnoea Syndrome: Definitions, Epidemiology, and Natural History,* Thorax 2004;59:73-78 (6 pages).
Pyke, Josh, et al, *Continuous Pulse Oximetry Monitoring in the Inpatient Population,* Patient Safety & Quality Healthcare, May/Jun. 2009 (5 pages).
EP Search Report for Application No. EP 13 79 3571, dated Sep. 8, 2015 (9 pages).
Service Manual—"TotalCare® Bed System" from Hill-Rom, Product No. P1900, MAN112 REV 7, by Hill-Rom Services, Inc. (2007) (1105 pages).
User Manual—"TotalCare® Bed System" from Hill-Rom, Product No. P1900, USR042 REV11, by Hill-Rom Services, Inc. (2007) (112 pages).
SleepEducation-Blog, "Positional therapy harness helps reduce sleep apnea for some," www.sleepeducation.com, posted Friday, Jun. 18, 2010 (7 pages).
SPANAmerica: PressureGuard® TurnSelect®, www.archive.org/web/20090201172625/http://spanamerica.com/turn_select.php; Aug. 18, 2014 (2 pages).
PCT Search Report and Written Opinion for PCT/US2014/18033, completed Aug. 18, 2014.
PCT Search Report for PCT/US2013/042313, completed Dec. 6, 2013.
EP Search Report for Application No. 15180086.9-1651, dated Dec. 22, 2015, 7 pages.
Japanese Office Action for Japanese Patent Application No. 2017-073542 dated Feb. 7, 2018 and its English translation; 11 pages total.
Japanese Patent Application Publication No. JP 2011-143237A dated Jul. 28, 2011 and its machine-generated English translation; 34 pages total.
PCT Patent Application Publication No. WO 2013/031504 A1 published on Mar. 7, 2018 and the English translation of the Abstract only; 63 pages total.

* cited by examiner

APPARATUS FOR GRADUATED LATERAL ROTATION OF A SLEEP SURFACE

CROSS-REFERENCE TO RELATED APPLICATIONS

This application claims priority to U.S. Provisional Patent Application Ser. No. 62/531,985, filed Jul. 13, 2017 and titled "APPARATUS FOR GRADUATED LATERAL ROTATION OF A SLEEP SURFACE," which is herein incorporated by reference in its entirety.

BACKGROUND

The subject matter disclosed herein relates generally to adverse event mitigation devices, systems, and methods and, more particularly, but not exclusively, to devices, systems, and methods for the prevention and treatment of sleep apnea. These devices, systems, and methods may include an active intervention, a passive intervention, or a continuous intervention. The embodiments described herein may also be effective in reducing snoring.

While various adverse event mitigation devices, systems, and methods have been developed, there is still room for improvement. Thus, a need persists for further contributions in this area of technology.

SUMMARY

The present disclosure includes one or more of the features recited in the appended claims and/or the following features which, alone or in any combination, may comprise patentable subject matter.

In one aspect, a lateral rotation apparatus includes a person support surface comprising head, torso and leg segments each having an independently rotatable person support plane. A first adjustable frame is positioned below the head segment and operable to rotate the head segment of the person support surface to a head tilt angle. The first adjustable frame includes an upper frame, a lower frame, and a linkage assembly connecting the upper frame of the first adjustable frame to the lower frame of the first adjustable frame. The linkage assembly includes at least one link that is operable to rotate the upper frame of the first adjustable frame with respect to the lower frame of the first adjustable frame such that the upper frame of the first adjustable frame is angled with respect to the lower frame of the first adjustable frame to provide a head tilt angle approximately at a centerline of the head segment that is in the range of about 7 to about 30 degrees relative to a horizontal support plane. A second adjustable frame is positioned below the torso segment and operable to rotate the torso segment of the person support surface to a torso tilt angle. The second adjustable frame includes an upper frame, a lower frame, and a linkage assembly connecting the upper frame of the second adjustable frame to the lower frame of the second adjustable frame. The linkage assembly of the second adjustable frame includes at least one link that is operable to rotate the upper frame of the second adjustable frame with respect to the lower frame of the second adjustable frame such that the upper frame of the second adjustable frame is angled with respect to the lower frame of the second adjustable frame to provide a torso tilt angle approximately at a centerline of the torso segment that is in the range of about 5 to about 10 degrees less than the head tilt angle.

The first adjustable frame and the second adjustable frame provide a graduated lateral rotation of the person support surface.

In some embodiments, the first adjustable frame and the second adjustable frame are not connected. In some embodiments, the lower frame of the first adjustable frame and the lower frame of the second adjustable frame are integrally formed, and the upper frame of the first adjustable frame moves independently of the upper frame of the second adjustable frame. In some embodiments, the upper frame of the first adjustable frame and the upper frame of the second adjustable frame are in contact with the person support surface.

In some embodiments, a jack is coupled to the upper frame and lower frame of the first adjustable frame and is operable to actuate the linkage assembly of the first adjustable frame. In some embodiments, the jack includes a lock to maintain a rotational angle of the upper frame of the first adjustable frame with respect to the lower frame of the first adjustable frame. In some embodiments, a jack is coupled to the upper frame and lower frame of the second adjustable frame and is operable to actuate the linkage assembly of the second adjustable frame. In some embodiments, the jack includes a lock to maintain a rotational angle of the upper frame of the second adjustable frame with respect to the lower frame of the second adjustable frame.

In some embodiments, the lower frame of the first adjustable frame includes a plurality of slots. The at least one link of the first adjustable frame is coupled to the upper frame of the first adjustable frame at a first end such that a second end of the at least one link is positionable within one of the plurality of slots of the lower frame of the first adjustable frame. In some embodiments, an angle of the upper frame of the first adjustable frame with respect to the lower frame of the first adjustable frame is determined by a position of a slot of the plurality of slots in which the second end of the at least one link of the first adjustable frame is positioned. In some embodiments, the lower frame of the second adjustable frame includes a plurality of slots. The at least one link of the second adjustable frame is coupled to the upper frame of the second adjustable frame at a first end such that a second end of the at least one link is positionable within one of the plurality of slots of the lower frame of the second adjustable frame. In some embodiments, an angle of the upper frame of the second adjustable frame with respect to the lower frame of the second adjustable frame is determined by a position of a slot of the plurality of slots in which the second end of the at least one link of the second adjustable frame is positioned.

In some embodiments, the at least one link of the first adjustable frame includes a four-bar linkage. In some embodiments, the at least one link of the second adjustable frame includes a four-bar linkage. In some embodiments, the at least one link of the first adjustable frame includes a gas spring. In some embodiments, the at least one link of the second adjustable frame includes a gas spring.

In some embodiments, an actuator connects the upper frame of the first adjustable frame to the lower frame of the first adjustable frame. The actuator actuates the at least one link of the first adjustable frame. In some embodiments, the actuator includes an electromechanical device. In some embodiments, an actuator connects the upper frame of the second adjustable frame to the lower frame of the second adjustable frame. The actuator actuates the at least one link of the second adjustable frame. In some embodiments, the actuator includes an electromechanical device.

In some embodiments, the torso segment is rotated to a torso tilt angle approximately at a centerline of the torso segment in the range of about zero to about 25 degrees.

In some embodiments, the head segment is rotated to a head tilt angle approximately at a centerline of the head segment in the range of about 10 to about 15 degrees. In such an embodiment, the torso segment is rotated to a torso tilt angle approximately at a centerline of the torso segment in the range of about 5 to about 10 degrees.

In some embodiments, a third adjustable frame is positioned below the leg segment and is operable to rotate the leg segment to a leg tilt angle approximately at a centerline of the leg segment in the range of about 0 to about 5 degrees.

In some embodiments, the person support surface includes a support material having a density. The head tilt angle is a function of the density of the support material. In some embodiments, the torso tilt angle is a function of the density of the support material.

In another aspect, a lateral rotation apparatus includes a first adjustable frame positioned under a head segment of a person support surface and operable to rotate the head segment of the person support surface to a head tilt angle approximately at a centerline of the head segment in the range of about 7 to about 30 degrees relative to a horizontal support plane. A second adjustable frame is positioned under a torso segment of the person support surface and is operable to rotate the torso segment of the person support surface to a torso tilt angle approximately at a centerline of the torso segment that is within a range of about 5 degrees to about 10 degrees less than the head tilt angle. The first adjustable frame and the second adjustable frame provide a graduated lateral rotation of the person support surface. Each of the first adjustable frame and the second adjustable frame includes an upper frame, a lower frame, and a linkage assembly connecting the upper frame to the lower frame. The linkage assembly includes at least one link that is operable to rotate the upper frame with respect to the lower frame.

In some embodiments, the first adjustable frame and the second adjustable frame are not connected. In some embodiments, the lower frame of the first adjustable frame and the lower frame of the second adjustable frame are integrally formed. The upper frame of the first adjustable frame moves independently of the upper frame of the second adjustable frame. In some embodiments, the upper frame is in contact with the person support surface.

In some embodiments, a jack is coupled to the upper frame and lower frame and is operable to actuate the linkage assembly. In some embodiments, the jack includes a lock to maintain a rotational angle of the upper frame with respect to the lower frame.

In some embodiments, the lower frame includes a plurality of slots. The at least one link is coupled to the upper frame at a first end such that a second end of the at least one link is positionable within one of the plurality of slots of the lower frame. In some embodiments, an angle of the upper frame with respect to the lower frame is determined by a position of a slot of the plurality of slots in which the second end of the at least one link is positioned.

In some embodiments, the at least one link includes a four-bar linkage. In some embodiments, the at least one link includes a gas spring. In some embodiments, an actuator connects the upper frame to the lower frame. The actuator actuates the at least one link. In some embodiments, the actuator includes an electromechanical device.

In some embodiments, the torso segment is rotated to a torso tilt angle approximately at a centerline of the torso segment in the range of about zero to about 25 degrees.

In some embodiments, the head segment is rotated to a head tilt angle approximately at a centerline of the head segment in the range of about 10 to about 15 degrees. In such an embodiment, the torso segment is rotated to a torso tilt angle approximately at a centerline of the torso segment in the range of about 5 to about 10 degrees.

In some embodiments, a third adjustable frame is positioned below the leg segment and is operable to rotate the leg segment to a leg tilt angle approximately at a centerline of the leg segment in the range of about 0 to about 5 degrees.

In some embodiments, the person support surface includes a support material having a density. The head tilt angle is a function of the density of the support material. In some embodiments, the torso tilt angle is a function of the density of the support material.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
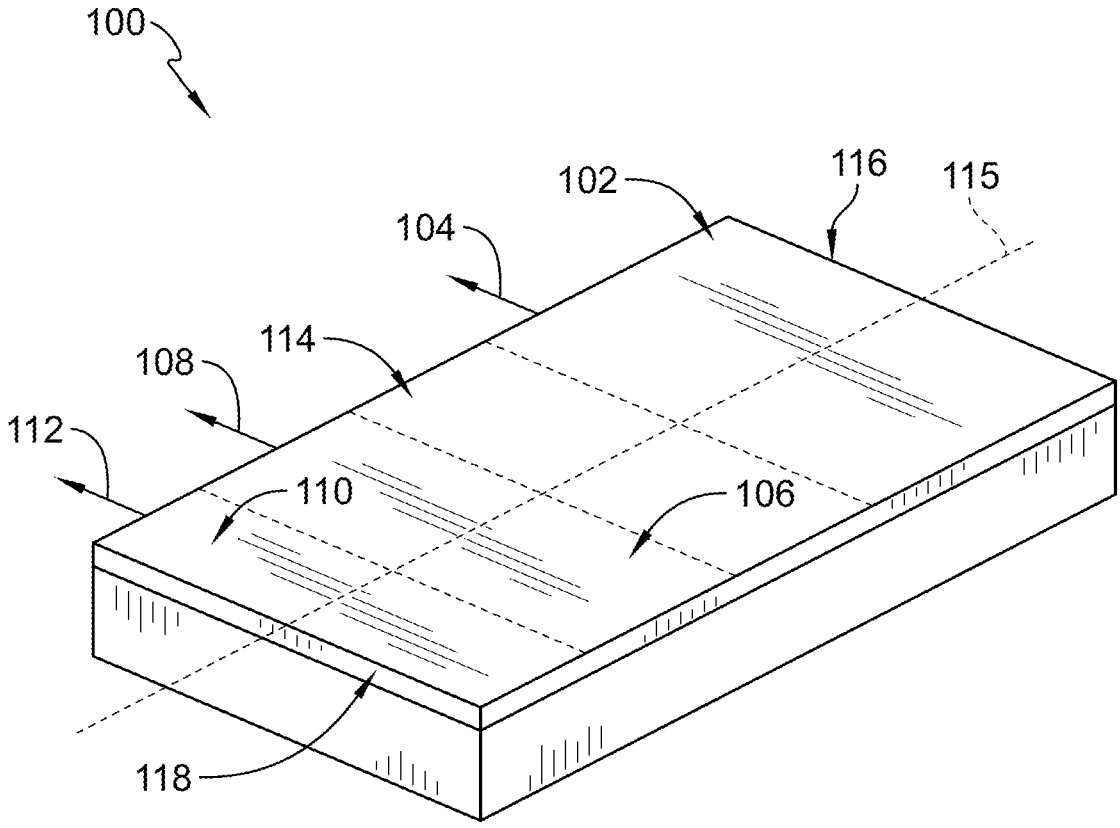
FIG. 1 is a perspective view of a patient support surface illustrated as a mattress.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

The embodiments described herein relate to devices, systems and methods to reduce the occurrence and/or duration of or prevent sleep apnea events and/or snoring. The embodiments demonstrate efficacy in preventing mild to moderate obstructive sleep apnea, with improved tolerability relative to current therapy (i.e., CPAP).

The described devices, systems and methods are not limited to the specific embodiments described herein. In addition, components of each device, system and/or steps of each method may be practiced independent and separate from other components and method steps, respectively, described herein. Each component and method also can be used in combination with other systems and methods.

Referring to FIG. 1, a support system 100 includes a support surface having one or more support sections that are angled to form a lateral support plane that prevents or restricts the user from sleeping in a supine position, and, more specifically, reduces a time duration that the user sleeps with his/her upper respiratory tract oriented vertically or at an undesirable lateral rotational angle with respect to a vertical plane substantially perpendicular to a horizontal plane of the support surface. In certain embodiments, the lateral rotational angle of the user's head with respect to the vertical plane is at least 30 degrees and, more specifically, at least 45 degrees. In an alternative embodiment, the lateral rotational angle of the user's head with respect to the vertical plane may be less than 30 degrees. In one embodiment, the support sections provide multiple support planes for supporting the user's body.

In one embodiment as shown in FIG. 1, a support system 100 suitable for supporting a user, such as a person, for example, includes plurality of support sections, namely a first or leg support section 102 forming a first support plane 104, a second or torso support section 106 forming a second support plane 108, and a third or head support section 110 forming a third support plane 112 that collectively define a multi-plane, sleep surface 114 that may be progressively angled along a longitudinal axis 115 of support system 100, from a first or bottom edge 116 of sleep surface 114 to an opposing second or top edge 118 of sleep surface 114, resulting in relatively greater rotation of the upper respiratory tract of the user (as necessary for efficacy in preventing obstructive apnea) and relatively lesser rotation in the lower body of the user (resulting in greater comfort and perceived stability by avoiding rotation of a majority of the user's body mass).

Unlike conventional positional therapies for the prevention of obstructive sleep apnea, which attempt to manipulate the user's sleep position and/or orientation using rotation of one plane, in certain embodiments the system described herein uses multiple support planes formed by one or more support sections to laterally rotate the user. For example, in one embodiment, two support sections provide two separate support planes, with a first support plane defined by the first support section configured to support the torso and the legs of the user, and a second support plane defined by the second support section configured to support the neck and the head of the user.

In an alternative embodiment, three support sections provide three separate support planes, with a first support plane defined by the first support section configured to support the legs of the user, a second support plane defined by the second support section configured to support the torso of the user, and a third support plane defined by the third support section configured to support the head of the user.

In a further alternative embodiment, more than three support sections, for example, numerous independent support sections having a length in a longitudinal direction of sleep surface 114 of 2-18 inches or, more specifically, 4-12 inches, or, even more specifically, 6 inches, provide a corresponding number of separate support planes. Each support section can be laterally rotated independently of other support sections to collectively form sleep surface 114. In a particular embodiment, the numerous support sections can be combined to form separate support sections, for example, creating a first support section having a length of 18 inches in the longitudinal direction at the foot of the support surface, an adjacent second support section having a length of 12 inches in the longitudinal direction, and a third support section adjacent the second support section having a length in the longitudinal direction of 6 inches. In these embodiments, the support sections forming the support planes can be rotated as necessary or desired to achieve an optimal configuration that is clinically effective (i.e., prevents apnea) and demonstrates acceptable tolerance (i.e., allows the user to sleep comfortably). In an alternative embodiment, a continuously sloped sleep surface is formed by a plurality of support sections without step increases in lateral rotational angle; this is illustrated as a sleep surface with an infinite number of support sections.

In the embodiments described herein, the length in the longitudinal direction of each support section and defined support plane (and the resulting location of transitions between support planes) is designed to achieve clinical efficacy and tolerability. Therefore, a specific length can be defined in a number of configurations, including without limitations: (a) generic plane dimensions (e.g., based on average body geometry, a length of a torso section of the user defined so that when an average user's head is supported by a head support section, a transition between the torso support section and the leg support section occurs below the user's S3 vertebrae); (b) customized plane dimensions (e.g., a torso support plane has a suitable length in the longitudinal direction appropriate to the user's leg length, torso length, and/or a distance from the user's shoulder to his/her inseam); or (c) dynamic plane dimensions (e.g., transitions selected on dynamic surface appropriate to user, selection being either user-selected, care-giver defined, or automatically calculated).

Figure 2:
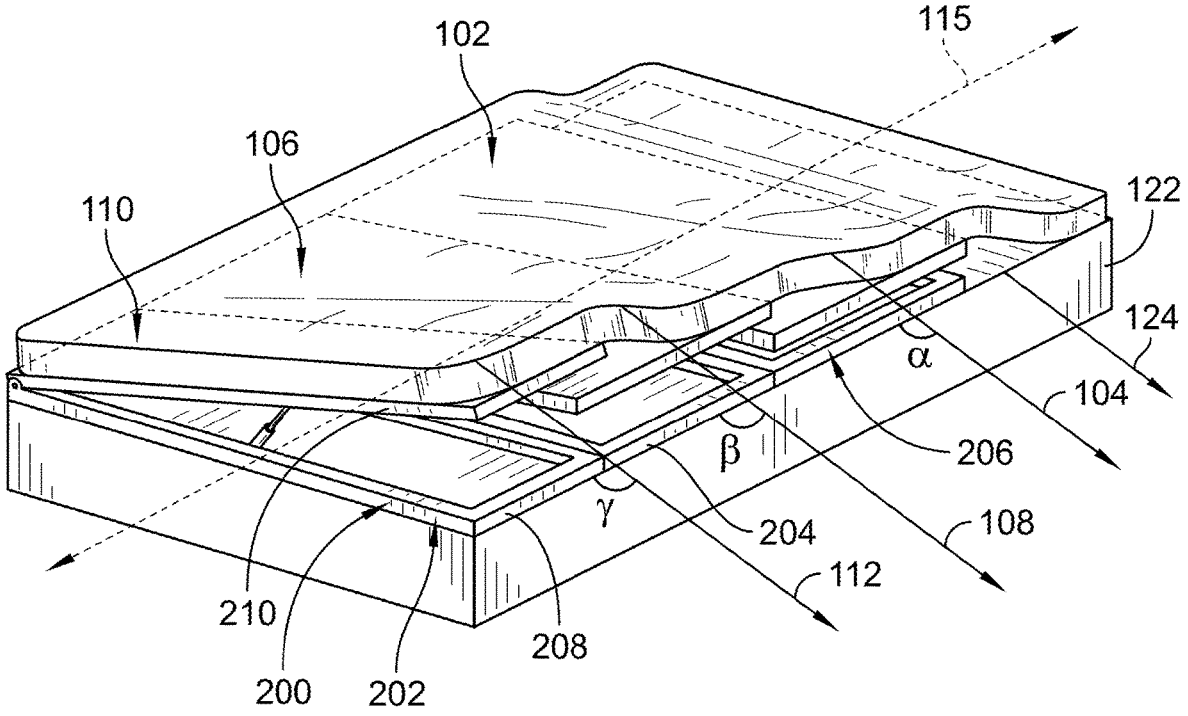
FIG. 2 is a perspective view of a lateral rotation apparatus in accordance with an embodiment and positioned between the patient support apparatus and a horizontal support plane illustrated as a box spring.
Figure 3:
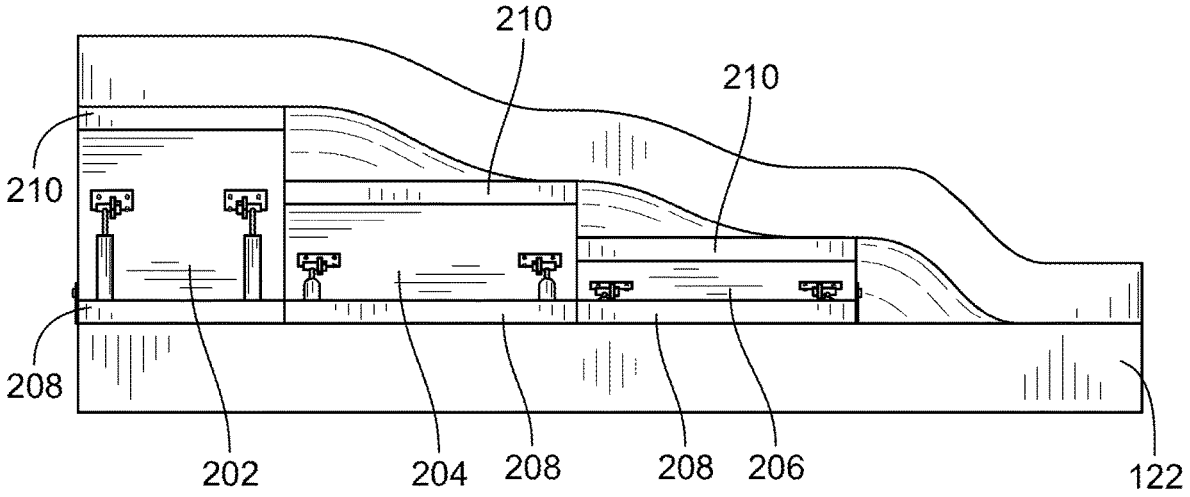
FIG. 3 is a side view of the lateral rotation apparatus positioned between the patient support apparatus and a horizontal support plane illustrated as a box spring.
Figure 4:
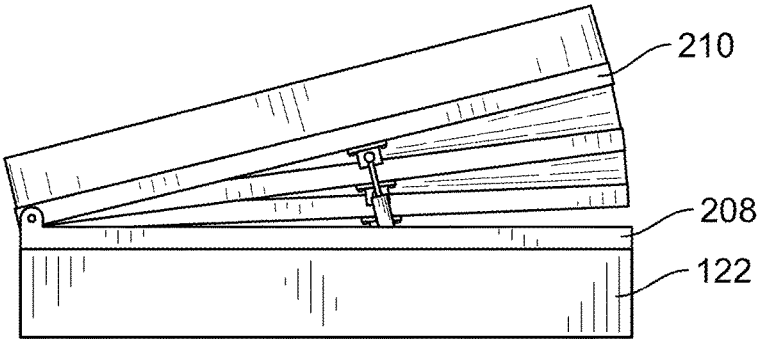
FIG. 4 is a head view of the lateral rotation apparatus positioned between the patient support apparatus and a horizontal support plane illustrated as a box spring.

Referring to FIGS. 2-4, a lateral rotation apparatus 200 is provided in the form of a frame positioned between the support system 100 and a horizontal support plane 124 to provide a gradual lateral rotation of the support system 100. In the illustrative embodiment, the lateral rotation apparatus 200 includes a first adjustable frame 202, a second adjustable frame 204, and a third adjustable frame 206. The frames 202, 204, 206 are illustrated as individual separate frames that are not connected. In one embodiment, the frames 202, 204, 206 may be joined by a linkage assembly or the like that enables each frame 202, 204, 206 to be individually adjusted. Additionally or alternatively, the frames 202, 204, 206 may be secured together, for example at a base of each frame 202, 204, 206 such that each frame 202, 204, 206 is independently adjustable. The frames 202, 204, 206 may be formed from metal, plastic, or any other material suitable for supporting the support system 100.

The first frame 202 is positioned below the support section 110. The first frame 202 is operable to rotate the support section 110 to position the support section 110 at a head tilt angle relative to the horizontal support plane 124. For example, the first frame 202 may rotate the support section 110 to a head tilt angle approximately at a centerline of the head segment in the range of about 7 to about 30 degrees relative to a horizontal support plane. The second frame 204 is positioned below the support section 106. The second frame 204 is operable to rotate the support section 106 to a torso tilt angle relative to the horizontal support plane 124. For example, the second frame 204 may rotate the support section 106 to a torso tilt angle approximately at a centerline of the torso segment that is within a range of about 5 degrees to about 10 degrees less than the head tilt angle. The third frame 206 is positioned below the support section 102. The third frame 206 is operable to rotate the support section 102 to a leg tilt angle relative to the horizontal support plane 124. For example, the third frame 206 may rotate the support section 102 to a leg tilt angle approximately at a centerline of the leg segment in the range of about 0 to about 5 degrees. It should be noted that the measured rotation of the corresponding support section 102, 106, 110 is measured approximately at a centerline of the support section 102, 106, 110. A remainder of the support section 102, 106, 110 may have a different slope due to a weight of the support system 100, e.g. the mattress, a density of the support system 100, and/or a weight of an individual on the support surface. That is, the tilt angle within a particular support section 102, 106, 110 may vary throughout the support system 100. Generally, the frames 202, 204, 206 slope the support system 100 such that gradual lateral rotation is achieved between the support sections 102, 106, and 110.

Each of the frames 202, 204, 206 includes a lower frame 208 and an upper frame 210. The lower frame 208 is positioned on the horizontal support plane 124 with the upper frame 210 positioned thereabove. The support system 100 is positioned on the upper frame 210. The upper frame 210 is coupled to the lower frame 208 and rotatable with respect thereto. In one example, the upper frame 210 may be hingedly coupled to the lower frame 208. In such an embodiment, the upper frame 210 rotates about the hinge. The upper frame 210 rotates with respect to the lower frame 208 to create the desired head tilt angle, torso tilt angle, and leg tilt angle, respectively.

In one embodiment, the support system 100 is a mattress, wherein each of the support sections 102, 106, 110 are integrally formed. Alternatively, the support sections 102, 106, 110 may be separately formed. In yet another embodiment, only some of the support sections 102, 106, 110 may be integrally formed, for example support sections 102, 106 may be integrally formed or support sections 106, 110 may be integrally formed. The mattress may be any conventional mattress, i.e. spring mattress, pillow top mattress, foam mattress, air mattress, etc. or any suitable mattress utilized in a healthcare setting. The horizontal support plane 124 may be formed along a box spring, frame, or any other suitable device for retaining a mattress.

In certain embodiments, each support section defining the corresponding support surface is independently rotatable about an axis extending parallel with a longitudinal axis of the support system. The independent rotation of each support section allows the caregiver or the user ability to focus on progressively increasing an angle of rotation in one or more support sections having support planes positioned to support the torso of the user, and the neck and/or the head of the user. In certain embodiments, a rotational angle at which the one or more support planes defined by the support sections configured to support the neck and/or the head of the user is positioned is greater that a rotational angle of the one or more support planes defined by the support sections configured to support the torso of the user, which is greater than a rotational angle at which the one or more support planes defined by the support sections configured to support the legs of the user is positioned.

In a particular embodiment, the support plane defined by the support section configured to support the legs and the torso of the user is positioned at a rotational angle of approximately 10° with respect to a base plane of the support section, while the support plane defined by the support section configured to support the head of the user is positioned at a rotational angle of approximately 20° with respect to a base plane of the support section. In an alternative embodiment, a first support plane defined by the support section configured to support the legs of the user is positioned at a rotational angle of approximately 10° with respect to a base plane of the first support section, a second support plane defined by a second support section configured to support the torso of the user is positioned at a rotational angle of approximately 15° with respect to a base plane of the second support section, and a third support plane defined by the third support section configured to support the head of the user is positioned at a rotational angle of approximately 20° with respect to a base plane of the third support section. In alternative embodiments, the support planes can be positioned at any suitable rotational angle including any suitable lateral rotational angle and/or any suitable longitudinal rotational angle.

In a particular embodiment, first support section 102 defines support plane 104 positioned at a lateral rotational angle $\alpha$ of approximately 20° to approximately 30° approximately at a centerline of the first support section 102, or more specifically, approximately 20° to approximately 25°, or, even more specifically, approximately 25° with respect to the horizontal support plane 124. Second support section 106 defines support plane 108 positioned at a lateral rotational angle $\beta$ of approximately 10° to approximately 20° approximately at a centerline of the support section 106, or more specifically, approximately 10° to approximately 15°, or, even more specifically, approximately 15°, with respect to the horizontal support plane 124. Third support section 110 defines support plane 112 positioned at a lateral rotational angle γ of approximately 5° to approximately 15° approximately at a centerline of the third support section 110, or more specifically, approximately 10°, with respect to the horizontal support plane 124. Other lateral rotational angles and step increases in lateral rotational angles between each support section may also be used to achieve a progressive lateral rotational angle.

Each of first support section 102, second support section 106, and third support section 110 has a respective height in a direction perpendicular to longitudinal axis 115 of support system 100. In one embodiment, first support section 102 has a maximum height from the horizontal support plane 124 to support plane 104 in a direction perpendicular to longitudinal axis 115 of 14 to 18 inches approximately at a centerline of the first support section 102, or more specifically, 16 to 17 inches; second support section 106 has a maximum height from the horizontal support plane 124 to support plane 108 in a direction perpendicular to longitudinal axis 115 of 8 to 12 inches approximately at a centerline of the second support section 106, or more specifically, 9 to 10 inches; and third support section 110 has a maximum height from the horizontal support plane 124 to support plane 112 in a direction perpendicular to longitudinal axis 115 of 4 to 8 inches approximately at a centerline of the third support section 110, or more specifically, 6 to 7 inches. As a result, the support sections can be designed with desired heights and defining support planes positioned at desired rotational angles such that support system 100 provides a composite longitudinal plane angle (e.g., reverse Trendelenburg angle), to facilitate the prevention and/or treatment of sleep apnea as well as to improve tolerability.

In one embodiment, each of support sections 102, 106, 110 are rotatable about longitudinal axis 115 to provide sleep surface 114 having a right side slope or, alternatively, a left side slope to allow the user to sleep on his/her right side or left side, respectively. In certain embodiments, support sections 102, 106, 110 are formed of more than one material, for example, two or more materials, such as two foam materials, having different densities, with the less dense material covering the denser material.

In this embodiment, support system 100 allows the user to sleep on either his/her right side or left side, based on the user's sleeping preference. This sleeping preference may not be static. For example, if the user has an injury, an ache, or a desire to change his/her sleeping preference, the orientation of sleep surface 114 can be changed at any time to accommodate the user's sleeping preference. The orientation can be changed from day to day or during the night. Moreover, from a manufacturing standpoint, a versatile support system 100 prevents having to manufacture and distribute a sleep surface 114 having a right side slope and a separate sleep surface 114 having a left side slope, which would increase production and distribution costs. Finally, a potential purchaser would not have to commit to a sleep side before purchasing the product, which might be a deterrent to purchasing the product.

As described herein, sleep surface 114 is customizable to anthropometric dimensions of the individual user to facilitate support surface performance that optimizes or matches the design intent—the body position of the user will prevent or limit undesirable sleep apnea episodes and provide improved comfort. As illustrated in FIG. 3, the support sections 102, 106, 110 are not sloped evenly, e.g. the support sections 102, 106, 110 do not slope in a straight line. Rather the support sections 102, 106, 110 slope at different angles when sloping from head to foot or side to side.

Figure 5:
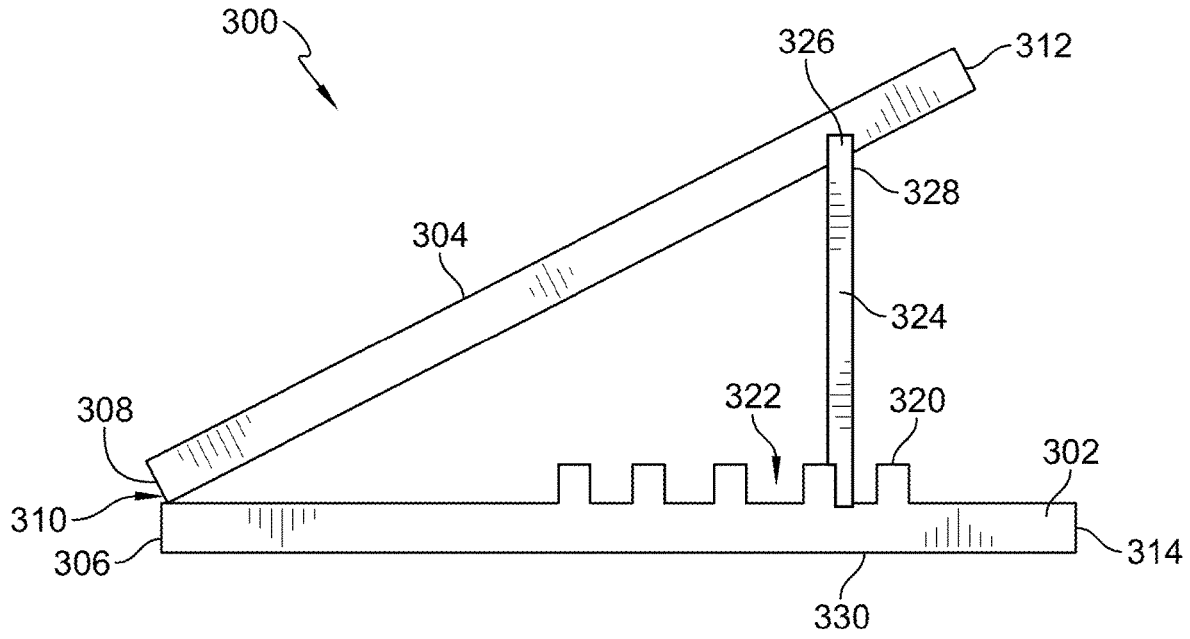
FIG. 5 is a perspective view of a lateral rotation apparatus in accordance with an embodiment and in a first position.

Referring to FIG. 5 an exemplary adjustable frame 300 includes a lower frame 302 and an upper frame 304. The frame 300 may be positioned under any one of the support section 102, the support section 106, or the support section 110. The lower frame 302 includes a fixed end 306 that is coupled to a fixed end 308 of the upper frame 304 at a hinge 310. The upper frame 304 rotates with respect to the lower frame 302 about the hinge 310 so that an end 312 of the upper frame 304 that is opposite the fixed end 308 moves with respect to an end 314 of the lower frame 302 that is opposite the fixed end 306. The upper frame 304 rotates with respect to the lower frame 302 to create a desired angle as described above. For example, the frame 300 may be utilized to create a desired head tilt angle, torso tilt angle, or leg tilt angle.

The lower frame 302 includes a plurality of ribs 320 defining a plurality of slots 322 between adjacent ribs 320. The upper frame 304 includes a leg 324 coupled thereto at a pivot point 326. A fixed end 328 of the leg 324 rotates about the pivot point 326 so that a free end 330 of the leg 324 moves with respect to the upper frame 304. The free end 330 of the leg 324 is configured to be positioned within one of the slots 322 such that an angle of the upper frame 304 with respect to the lower frame 302 is fixed. As shown in FIG. 5, by positioning the leg 324 is a slot 322 adjacent the end 314 of the lower frame 302 a first angle is formed between the upper frame 304 and the lower frame 302.

Figure 6:
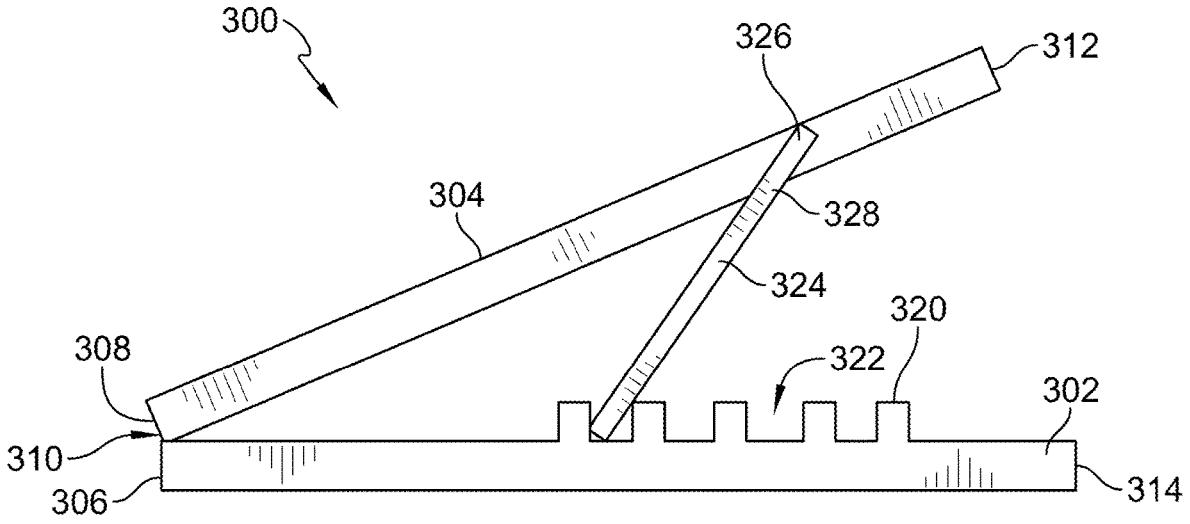
FIG. 6 is a perspective view of a lateral rotation apparatus in accordance with an embodiment and in a second position.

As shown in FIG. 6, moving the leg 324 to the slot 322 adjacent the fixed end 306 of the lower frame 302 positions the upper frame 304 at a second angle with respect to the lower frame 302, wherein the second angle is smaller than the first angle. Intermediate angles between the first angle and the second angle may be achieved by positioning the leg 324 in a slot 322 between the slot 322 adjacent the fixed end 306 and the slot 322 adjacent the end 314. Accordingly, the angle of the upper frame 304 with respect to the lower frame 302 is adjustable to any of the above-referenced angles by positioning the leg 324 in one of the plurality of slots 322.

Figure 7:
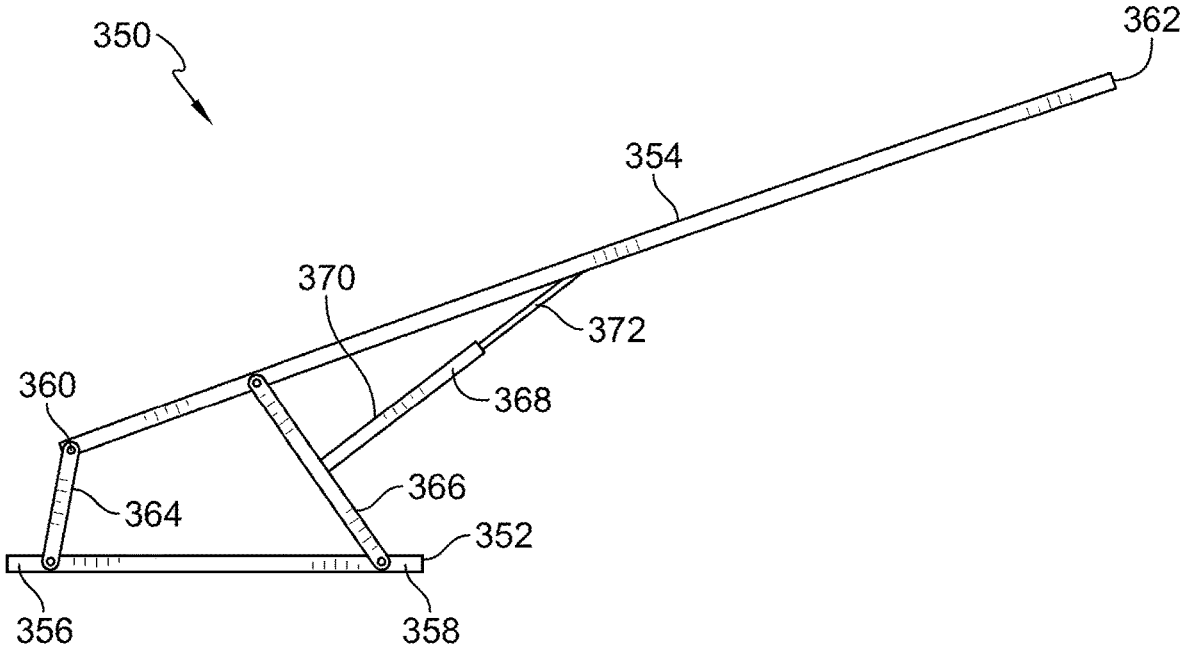
FIG. 7 is a perspective view of a lateral rotation apparatus in accordance with another embodiment.

Referring to FIG. 7, an exemplary adjustable frame 350 includes a lower frame 352 and an upper frame 354. The frame 350 may be positioned under any one of the support section 102, the support section 106, or the support section 110. The lower frame 352 includes a first end 356 and a second end 358. The upper frame 354 includes a first end 360 and a second end 362. A first rotating arm 364 is pivotally coupled to both the first end 356 of the lower frame 352 and the first end 360 of the upper frame 354. A second rotating arm 366 is pivotally coupled to both the second end 358 of the lower frame 352 and an intermediate position of the upper frame 354 between the first end 360 and the second end 362. A telescoping arm 368 extends from the rotating arm 366 to another intermediate position of the upper frame 354 between the second end 362 and the coupling position of the rotating arm 366 on the upper frame 354.

The telescoping arm 368 includes a base arm 370 that is pivotally coupled to the rotating arm 366 and a movable arm 372 that is pivotally coupled to the upper frame 354. The moveable arm 372 extends and retracts with respect to the base arm 370. The base arm 370 includes a biasing mechanism (not shown) therein that retains a position of the moveable arm 372 with respect to the base arm 370. For example, the biasing mechanism may be a gas or a spring. The moveable arm 372 is configured to move between a plurality of extended and retracted positions with respect to the base arm 370. The moveable arm 372 is retained in position by the biasing mechanism.

As the moveable arm 372 extends, the upper frame 354 is rotated with respect to the lower frame 352. The rotating arms 364, 366 each rotate with respect to both the lower frame 352 and the upper frame 354 so that the second end 360 of the upper frame 354 is moved away from the second end 358 of the lower frame 352. That is, a height of the second end 360 of the upper frame 354 relative to the lower frame 352 is increased, thereby increasing an angle of the upper frame 354 relative to the lower frame 352. The biasing mechanism retains the moveable arm 372 to retain the angle of the upper frame 352 relative to the lower frame 354.

As the moveable arm 372 retracts, the upper frame 354 is rotated with respect to the lower frame 352. The rotating arms 364, 366 each rotate with respect to both the lower frame 352 and the upper frame 354 so that the second end 360 of the upper frame 354 is moved toward the second end 358 of the lower frame 352. That is, a height of the second end 360 of the upper frame 354 relative to the lower frame 352 is decreased, thereby decreasing an angle of the upper frame 354 relative to the lower frame 352. The biasing mechanism retains the moveable arm 372 to retain the angle of the upper frame 352 relative to the lower frame 354.

The moveable arm 372 may be retained by the biasing mechanism at any position between fully retracted and fully extended. Accordingly, the upper frame 354 may be retained at a plurality of angles relative to the lower frame 352, wherein the range of angles is dependent on the length of the telescoping arm 368. Particularly, the telescoping arm 368 may be selected to extend and retract within a first range of lengths, thereby provided a first range of angles. Likewise, the telescoping arm 368 may be selected to extend and retract within a second range of lengths that is greater or less than the first range of lengths to provide a second ranges of angles that are greater or less than the first range of angles, respectively. Accordingly, the angle of the upper frame 354 with respect to the lower frame 352 is adjustable to any of the above-referenced angles by adjusting a length of the telescoping arm 368 by extending and retracting the moveable arm 372.

Figure 8:
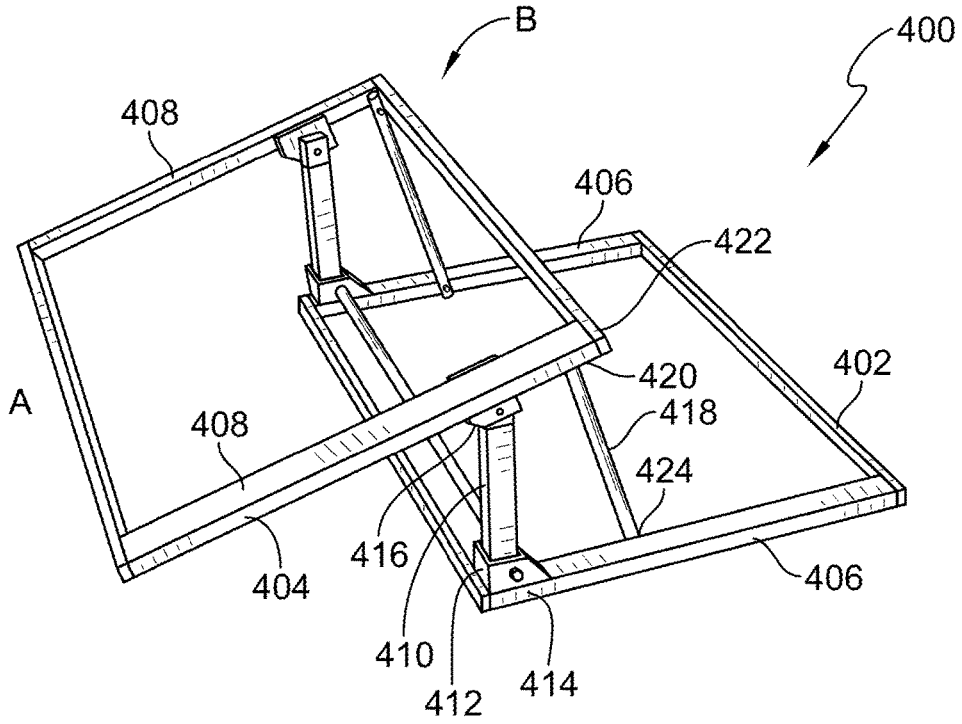
FIG. 8 is a perspective view of a lateral rotation apparatus in accordance with yet another embodiment.

Referring to FIG. 8, an exemplary adjustable frame 400 includes a lower frame 402 and an upper frame 404. The frame 400 may be positioned under any one of the support section 102, the support section 106, or the support section 110. The lower frame 402 includes a pair of tracks 406 extending a length of the lower frame 402. Another pair of tracks 408 extends a length of the upper frame 404. A pair of rotating arms 410 couple the lower frame 402 to the upper frame 404. A rotating end 412 of each rotating arm 410 is secured to a corner 414 of the lower frame 402. A sliding end 416 of each rotating arm 410 is secured to a track 408 of the upper frame 404. The sliding end 416 of each rotating arm 410 is configured to move laterally within the respective track 408. A second pair or rotating arms 418 also couples the lower frame 402 to the upper frame 404. A rotating end 420 of each rotating arm 418 is secured to a corner 422 of the upper frame 404. A sliding end 424 of each rotating arm 418 is secured to a track 406 of the lower frame 402. The sliding end 424 of each rotating arm 418 is configured to move laterally within the respective track 406.

In a collapsed position (not shown), the upper frame 404 is positioned on top of and aligned with the lower frame 402. The upper frame 404 rotates with respect to the lower frame 402 to an extended position, shown in FIG. 8. To rotate into the extended position, the rotating arms 410 are rotated about the rotating end 412, while the rotating arms 418 are rotated about the rotating end 420. Rotation of the rotating arms 410 causes the sliding end 416 of the rotating arms 410 to move or slide within the respective track 408. Likewise, rotation of the rotating arms 418 causes the sliding end 424 of the rotating arms 418 to move or slide within the respective track 406. Because the arms 418 are greater in length than the arms 410, the upper frame 404 is angled with respect to the lower frame 402 when the lateral rotation apparatus 400 is in the extended position, as illustrated in FIG. 8.

In some embodiments, adjustable frames 400 may be provided in various sizes. For example, the lower frame 402 and the upper frame 404 may be provided in various sizes. Likewise, the rotating arms 410 and 418 may be provided in various lengths. The sizes may be configured to provide a particular distance between the upper frame 404 and the lower frame 402, when the adjustable frame 400 is in the extended position. Accordingly, the distance between the upper frame 404 and the lower frame 402 and the angle of the upper frame 404 relative to the lower frame 402 are adjustable to achieve any of the above-referenced angles. For example, the frame 400 may be utilized to create a desired head tilt angle, torso tilt angle, or leg tilt angle.

Figure 9:
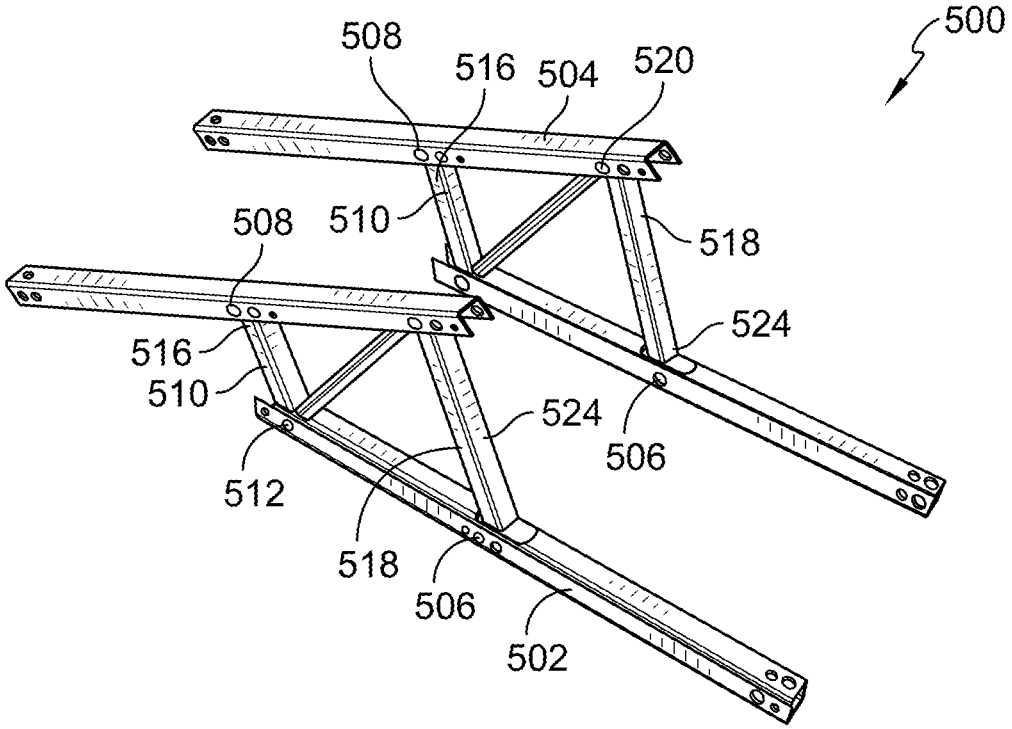
FIG. 9 is a perspective view of a lateral rotation apparatus in accordance with a further embodiment.

Referring to FIG. 9, an exemplary adjustable frame 500 is configured as a four-bar linkage. The frame 500 may be positioned under any one of the support section 102, the support section 106, or the support section 110. The adjustable frame 500 includes a lower frame 502 and an upper frame 404. A pair of rotating arms 510 couple the lower frame 502 to the upper frame 504. An end 512 of each rotating arm 510 is secured to the lower frame 502. An end 516 of each rotating arm 510 is secured to an intermediate position 508 of the upper frame 504. A second pair or rotating arms 518 also couples the lower frame 502 to the upper frame 504. An end 520 of each rotating arm 518 is secured to the upper frame 504. An end 524 of each rotating arm 518 is secured to an intermediate position 506 of the lower frame 502.

In a collapsed position (not shown), the upper frame 504 is positioned on top of and aligned with the lower frame 502. The upper frame 504 rotates with respect to the lower frame 502 to an extended position, shown in FIG. 9. To rotate into the extended position, the rotating arms 510 are rotated about both ends 512 and 516, while the rotating arms 518 are rotated about the both ends 520 and 524. A stabilizing arm 530 extends between the ends 512 of the rotating arms 510 and the ends 520 of the rotating arms 518 to retain the adjustable 500 in the extended position. Because the arms 518 are greater in length than the arms 510, the upper frame 504 is angled with respect to the lower frame 502 when the lateral rotation apparatus 500 is in the extended position, as illustrated in FIG. 9.

In some embodiments, adjustable frames 500 may be provided in various sizes. For example, the lower frame 502 and the upper frame 504 may be provided in various sizes. Likewise, the rotating arms 510 and 518 may be provided in various lengths. The sizes may be configured to provide a particular distance between the upper frame 504 and the lower frame 502, when the adjustable frame 500 is in the extended position. Accordingly, the distance between the upper frame 504 and the lower frame 502 and the angle of the upper frame 504 relative to the lower frame 502 are adjustable to achieve any of the above-referenced angles. For example, the frame 500 may be utilized to create a desired head tilt angle, torso tilt angle, or leg tilt angle.

Figure 10:
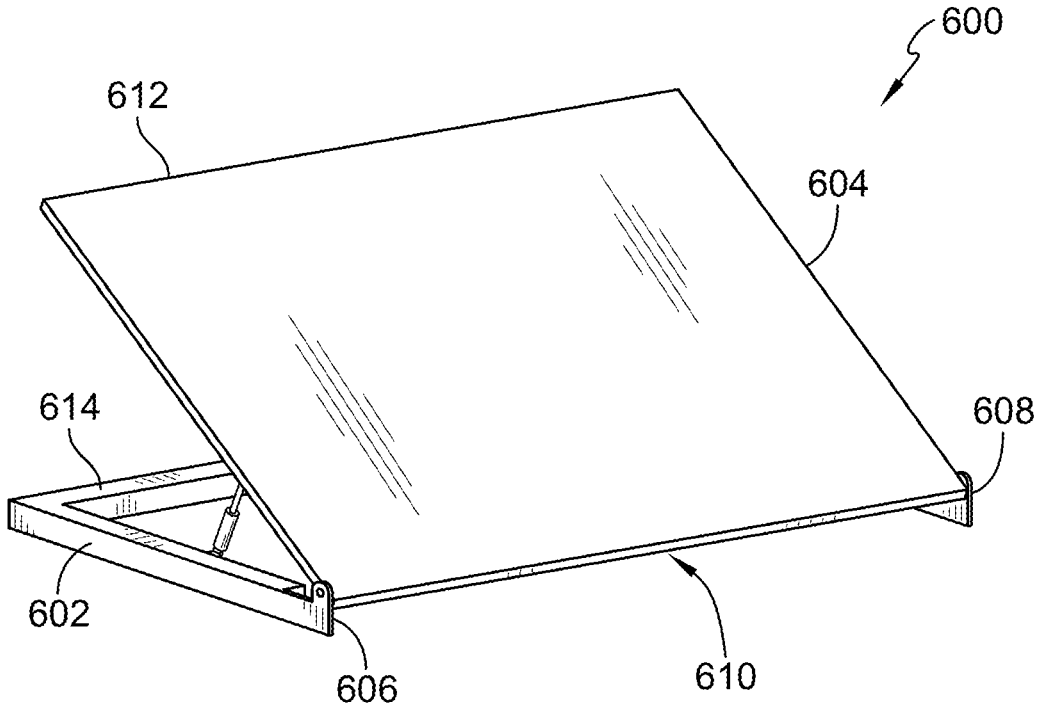
FIG. 10 is a perspective view of a lateral rotation apparatus in accordance with an embodiment.

Referring to FIG. 10, an exemplary adjustable frame 600 includes a lower frame 602 and an upper frame 604. The frame 600 may be positioned under any one of the support section 102, the support section 106, or the support section 110. The lower frame 602 includes a fixed end 606 that is coupled to a fixed end 608 of the upper frame 604 at a hinge 610. The upper frame 604 rotates with respect to the lower frame 602 about the hinge 610 so that an end 612 of the upper frame 604 that is opposite the fixed end 608 moves with respect to an end 614 of the lower frame 602 that is opposite the fixed end 606. Movement of the upper frame 604 with respect to the lower frame 602 may be controlled by any one of a telescoping arm, a hydraulic arm, an actuator, a jack, a gas spring, or the like. The upper frame 604 rotates with respect to the lower frame 602 to create a desired angle as described above. For example, the frame 600 may be utilized to create a desired head tilt angle, torso tilt angle, or leg tilt angle.

Figure 11:
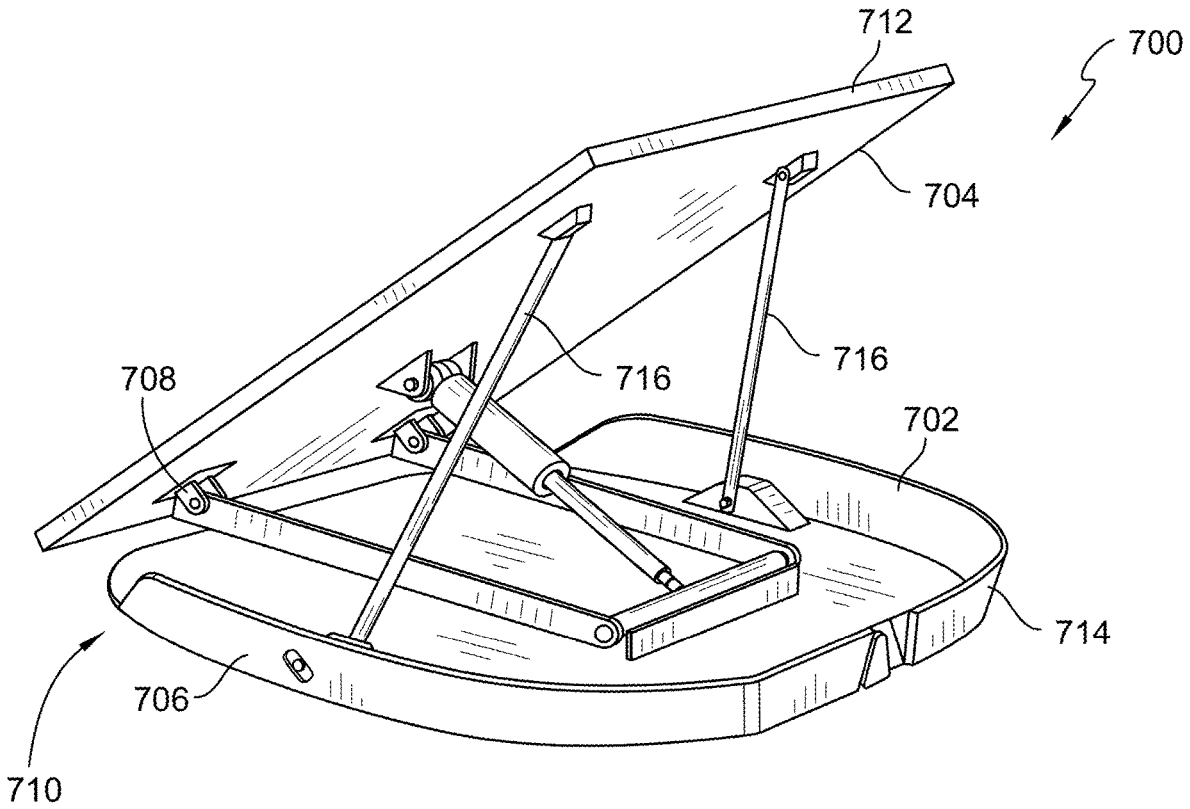
FIG. 11 is a perspective view of a lateral rotation apparatus in accordance with another embodiment.

Referring to FIG. 11, an exemplary adjustable frame 700 includes a lower frame 702 and an upper frame 704. The frame 700 may be positioned under any one of the support section 102, the support section 106, or the support section 110. The lower frame 702 includes a fixed end 706 that is coupled to a fixed end 708 of the upper frame 704 at a hinge 710. The upper frame 704 rotates with respect to the lower frame 702 about the hinge 710 so that an end 712 of the upper frame 704 that is opposite the fixed end 708 moves with respect to an end 714 of the lower frame 702 that is opposite the fixed end 706. Movement of the upper frame 704 with respect to the lower frame 702 is controlled by a telescoping hydraulic arm 718 that may be spring powered, gas powered, or the like. A pair of rotating arms 716 is coupled to both the upper frame 704 and the lower frame 702. The rotating arms 716 rotated about both the lower frame 702 and the upper frame 704 to control a motion of the upper frame 704 with respect to the lower frame 702. The rotating arms 716 may also provide stability to the upper frame 704 when the upper frame 704 is extended from the lower frame 702. The upper frame 704 rotates with respect to the lower frame 702 to create a desired angle as described above. For example, the frame 700 may be utilized to create a desired head tilt angle, torso tilt angle, or leg tilt angle.

Figure 12:
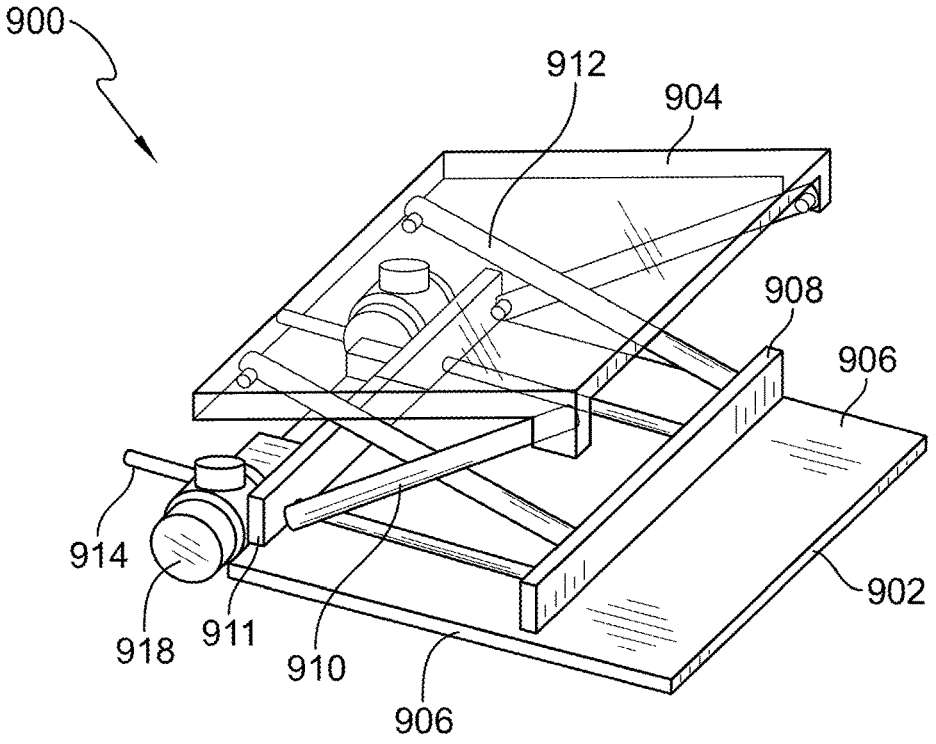
FIG. 12 is a perspective view of a lateral rotation apparatus in accordance with a further embodiment and in a collapsed configuration.
Figure 13:
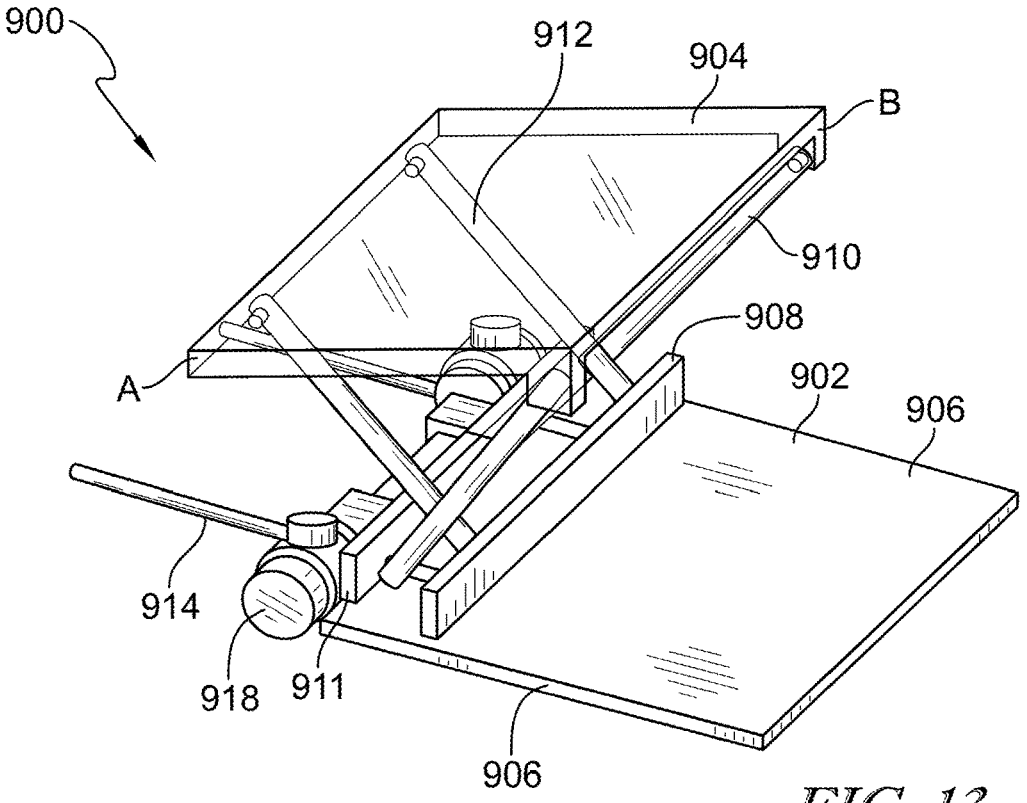
FIG. 13 is a perspective view of the lateral rotation apparatus of FIG. 11 in an extended configuration.

Referring to FIGS. 12 and 13, an exemplary adjustable frame 900 includes a lower frame 902 and an upper frame 904. The frame 900 may be positioned under any one of the support section 102, the support section 106, or the support section 110. The lower frame 902 includes a pair of tracks 906. A slide 908 extends between the pair of tracks 906 and is movably coupled to each of the pair of tracks 906. The slide 908 is configured to move along the pair of tracks 906. A pair of first arms 910 is fixed to the lower frame 902 at an end 911 and the upper frame 904. A pair of second arms 912 is fixed to the slide 908 and the upper frame 904. The first arm 910 and the second arm 912 are crossed in an X-configuration.

A screw 914 extends through one of the first arms 910 and is secured to one of the second arms 912. A screw 916 extends through the other of the first arms 910 and is secured to the other of the second arms 912. The screws 94 and 916 may be manually operated or operated by a motor 918. The screws 914 and 916 are actuated to move the slide 908 along the tracks 906. Moving the slide 908 causes the arms 910 and 912 to operate in a scissor motion. Particularly, when the slide 908 away from the end 911, the arms 910 and 912 are opened so that the upper frame 904 is positioned substantially adjacent to the lower frame 902 in a collapsed position, as illustrated in FIG. 12. As the slide 908 moves toward the end 911, the arms 910 and 912 are closed so that the upper frame 904 moves upward from the lower frame 902 to an extended position, as illustrated in FIG. 13. Accordingly, the upper frame 904 is raised with respect to the lower frame 902 by adjusting a position of the slide 908 to achieve any of the above-referenced angles. Additionally, an angle of the upper frame 904 relative to the lower frame 902 is increased as the upper frame 904 is raised relative to the lower frame 902. The frame 900 may be utilized to create a desired head tilt angle, torso tilt angle, or leg tilt angle as described above.

It should be appreciated that any of the adjustable frames described above may be operable with an actuator, for example, a motor, a jack, a screw jack, a hydraulic cylinder, a crank, or the like.

Figure 14:
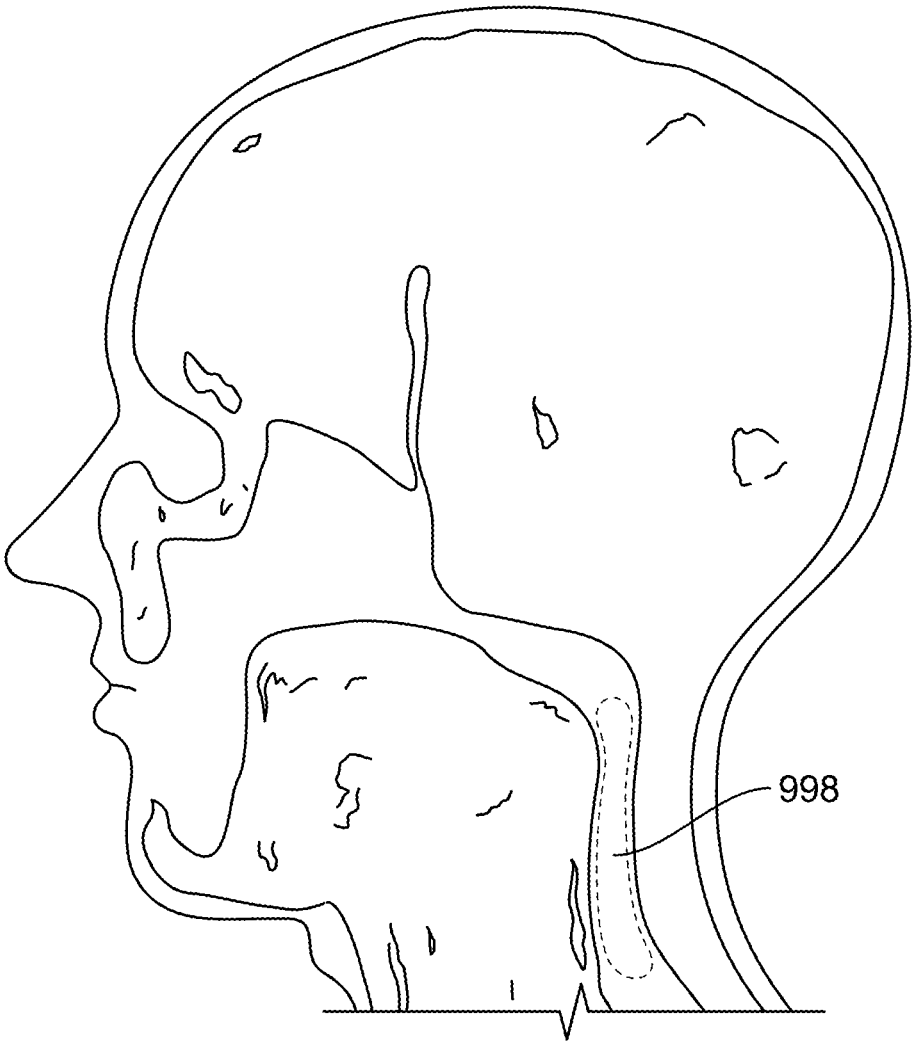
FIG. 14 is an MRI of a user laying on a support system in accordance with an embodiment.

Referring to FIG. 14, a sagittal distance 998 is defined in the airway of a user. The sagittal distance 998 is defined as an area of the user's esophagus that is opened while the user is laying on the support system 100. As illustrated in the graphs described below, the head tilt angle, the torso tilt angle and the leg tilt angle affects the sagittal distance 998 of the user.

Figure 15:
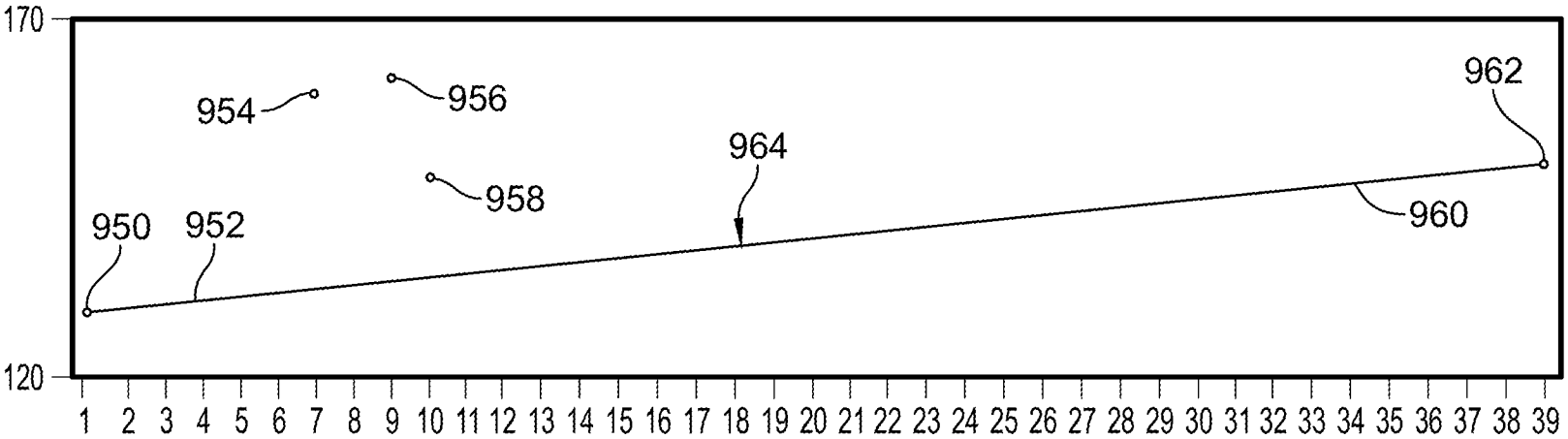
FIG. 15 is a graph showing a minimum airway area in relation to various tilt angles.

Referring to FIG. 15, a graph is provided showing a minimum airway area in relation to various tilt angles. Based on prior research in the field of sleep medicine, it was believed that a subject with Positional Obstructive Sleep Apnea (POSA) will suffer a disproportionate number of Apnea-Hypopnea Index events (or number of airway obstructions) when in the supine position than in the non-supine positon (i.e., upper airway rotated 90 degrees away from vertical). It has been assumed that changes in the airway would be either linear as the upper airway is rotated from vertical to 90 degrees from vertical, or more likely that the relationship be more binary, and that changes in the upper airway would be primarily seen once the upper airway was rotated to at or about 90 degrees from vertical.

However, based on research using Magnetic Resonance Imaging of the upper airways of patient previously diagnosed with POSA, this was not the case. Rather, in relevant measurements of the upper airway (for example, measurement of the minimum airway area in the retroglossal region), the relationship between head/torso support and minimum airway area was neither linear nor binary between 0 degree and 90 degree positons. As illustrated in FIG. 15, the research found that minimum airway area increased much more rapidly than a linear relationship and reached that level of improvement far before the 90 degree positon.

From point 950 (head angle at 0 degrees, torso angle at 0 degrees), head angle increases by 2.5 degrees until it is 5 degrees greater than the torso angle, so at point 952 the head angle is at 5 degrees and the torso angle is at 0 degrees, after which the head and torso angles each increase by 2.5 degrees until the head degree reaches 90 degrees at point 960, after which the torso angle increases by 2.5 degrees until both the head and torso angles are at 90 degrees at point 962. In FIG. 15, minimum airway area is plotted at point 950 (head angle at 0 degrees, torso angle at 0 degrees), point 954 (head angle at 15 degrees, torso angle at 10 degrees), point 956 (head angle at 20 degrees, torso angle at 15 degrees), point 958 (head angle at 22.5 degrees, torso angle at 17.5 degrees) and point 962 (head angle at 90 degrees, torso angle at 90 degrees), with the linear extrapolation between the measurements at point 950 and point 962 shown as line 964.

Referring to FIGS. 16-19, specific examples of measured sagittal distances 998 are represented through a series of graphs. It should be noted that the examples and data represented in the graphs of FIGS. 16-19 are exemplary only and non-limiting. It will be appreciated that various studies may be provided that result in other examples of data.

Figure 16:
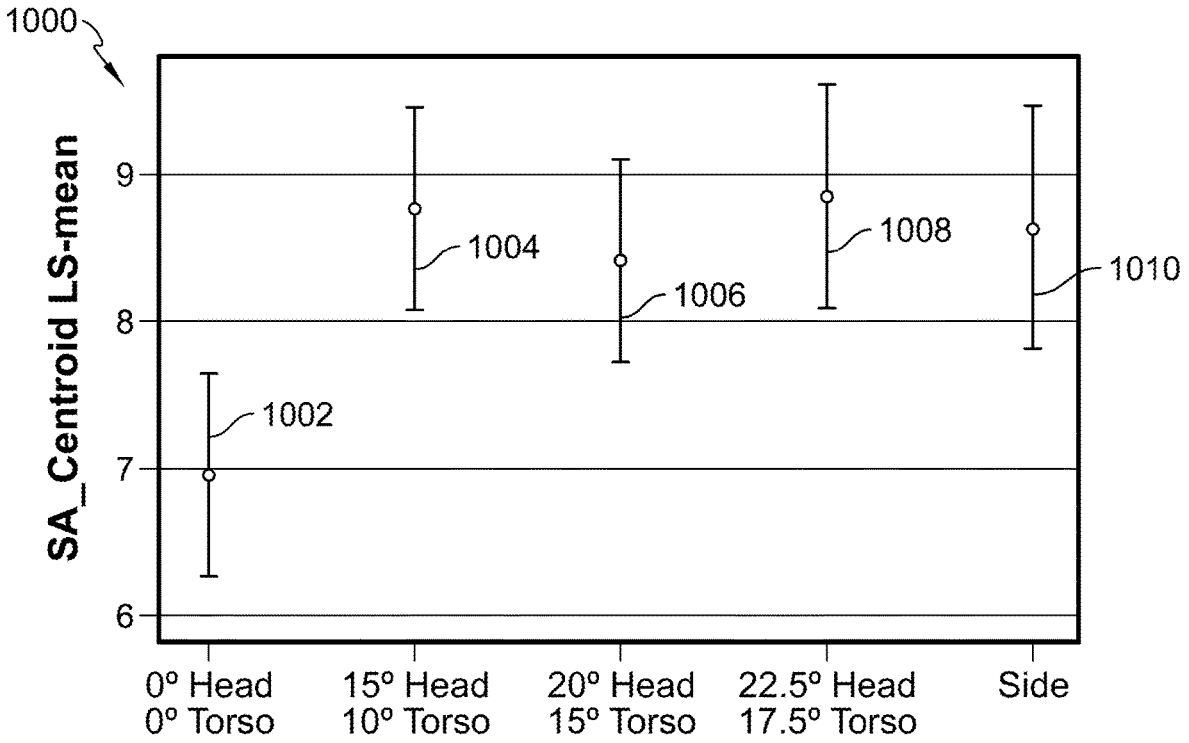
FIG. 16 is a graph of sleep surface orientations versus a minimum sagittal distance taken in a retroglossal region of a user positioned on the sleep surface.

Referring to FIG. 16, the graph 1000 illustrates sleep orientations on the x-axis versus a minimum sagittal distance on the y-axis in the retroglossal region of a user positioned on the sleep surface 114. As illustrated by line 1002, the minimum sagittal distance for a user in the supine position with the head at 0° with respect to the horizontal support plane 124 and the torso at 0° with respect to the horizontal support plane 124 is between approximately 6.25 $mm^2$ and approximately 7.75 $mm^2$ with a mean minimum sagittal distance of approximately 7 $mm^2$. As illustrated by line 1004, the minimum sagittal distance for a user with the lateral rotation apparatus rotating the head at 15° with respect to the horizontal support plane 124 and rotating the torso at 10° with respect to the horizontal support plane 124 is between approximately 8 $mm^2$ and approximately 9.5 $mm^2$ with a mean minimum sagittal distance of approximately 8.75 $mm^2$. As illustrated by line 1006, the minimum sagittal distance for a user with the lateral rotation apparatus rotating the head at 20° with respect to the horizontal support plane 124 and rotating the torso at 15° with respect to the horizontal support plane 124 is between approximately 7.75 $mm^2$ and approximately 9 $mm^2$ with a mean minimum sagittal distance of approximately 8.5 $mm^2$. As illustrated by line 1008, the minimum sagittal distance for a user with the lateral rotation apparatus rotating the head at 22.5° with respect to the horizontal support plane 124 and rotating the torso at 17.5° with respect to the horizontal support plane 124 is between approximately 8 $mm^2$ and approximately 9.75 $mm^2$ with a mean minimum sagittal distance of approximately 8.75 $mm^2$. As illustrated by line 1010, the minimum sagittal distance for a user lying on their side is between approximately 7.75 $mm^2$ and approximately 9.5 $mm^2$ with a mean minimum sagittal distance of approximately 8.5 $mm^2$. Accordingly, the user of the sleep surface 114 has a greater minimum sagittal distance when lying with the head at 22.5° with respect to the horizontal support plane 124 and rotating the torso at 17.5° with respect to the horizontal support plane 124 or when lying with the head at 15° with respect to the horizontal support plane 124 and rotating the torso at 10° with respect to the horizontal support plane 124. In all positions on the lateral rotation apparatus 200, the user has a greater minimum sagittal distance when compared to lying supine.

Figure 17:
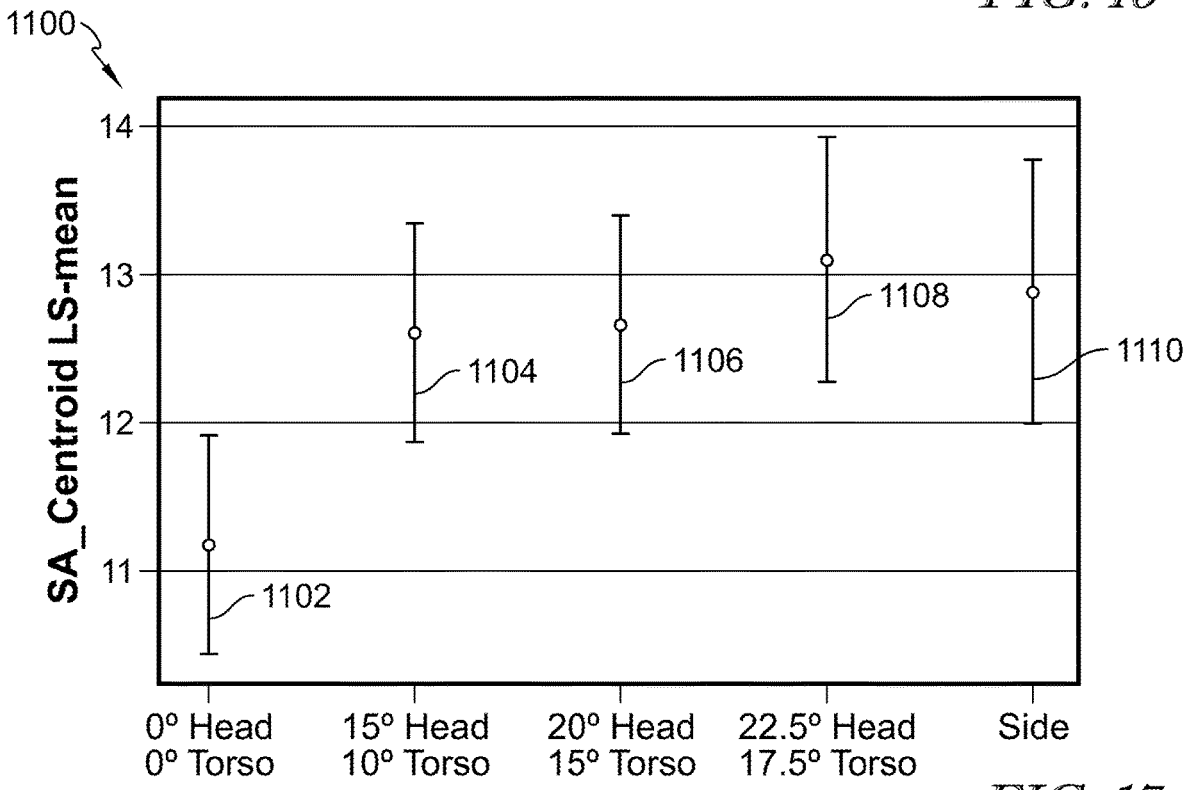
FIG. 17 is a graph of sleep surface orientations versus an average sagittal distance taken in a retroglossal region of a user positioned on the sleep surface.

Referring to FIG. 17, the graph 1100 illustrates sleep orientations on the x-axis versus an average sagittal distance on the y-axis taken in a retroglossal region of a user positioned on the sleep surface 114. As illustrated by line 1102, the average sagittal distance for a user in the supine position with the head at 0° with respect to the horizontal support plane 124 and the torso at 0° with respect to the horizontal support plane 124 is between approximately 10.25 $mm^2$ and approximately 11.75 $mm^2$ with a mean average sagittal distance of approximately 11.25 $mm^2$. As illustrated by line 1104, the average sagittal distance for a user with the lateral rotation apparatus rotating the head at 15° with respect to the horizontal support plane 124 and rotating the torso at 10° with respect to the horizontal support plane 124 is between approximately 11.75 $mm^2$ and approximately 13.5 $mm^2$ with a mean average sagittal distance of approximately 12.5 $mm^2$. As illustrated by line 1106, the average sagittal distance for a user with the lateral rotation apparatus rotating the head at 20° with respect to the horizontal support plane 124 and rotating the torso at 15° with respect to the horizontal support plane 124 is between approximately 11.75 $mm^2$ and approximately 13.5 $mm^2$ with a mean average sagittal distance of approximately 12.5 $mm^2$. As illustrated by line 1108, the average sagittal distance for a user with the lateral rotation apparatus rotating the head at 22.5° with respect to the horizontal support plane 124 and rotating the torso at 17.5° with respect to the horizontal support plane 124 is between approximately 12.25 $mm^2$ and approximately 13.75 $mm^2$ with a mean average sagittal distance of approximately 13.25 $mm^2$. As illustrated by line 1110, the average sagittal distance for a user lying on their side is between approximately 12 $mm^2$ and approximately 13.75 $mm^2$ with a mean average sagittal distance of approximately 12.75 $mm^2$. Accordingly, the user of the sleep surface 114 has a greater average sagittal distance when lying with the head at 22.5° with respect to the horizontal support plane 124 and rotating the torso at 17.5° with respect to the horizontal support plane 124. In all positions on the lateral rotation apparatus 200, the user has a greater average sagittal distance when compared to lying supine.

Figure 18:
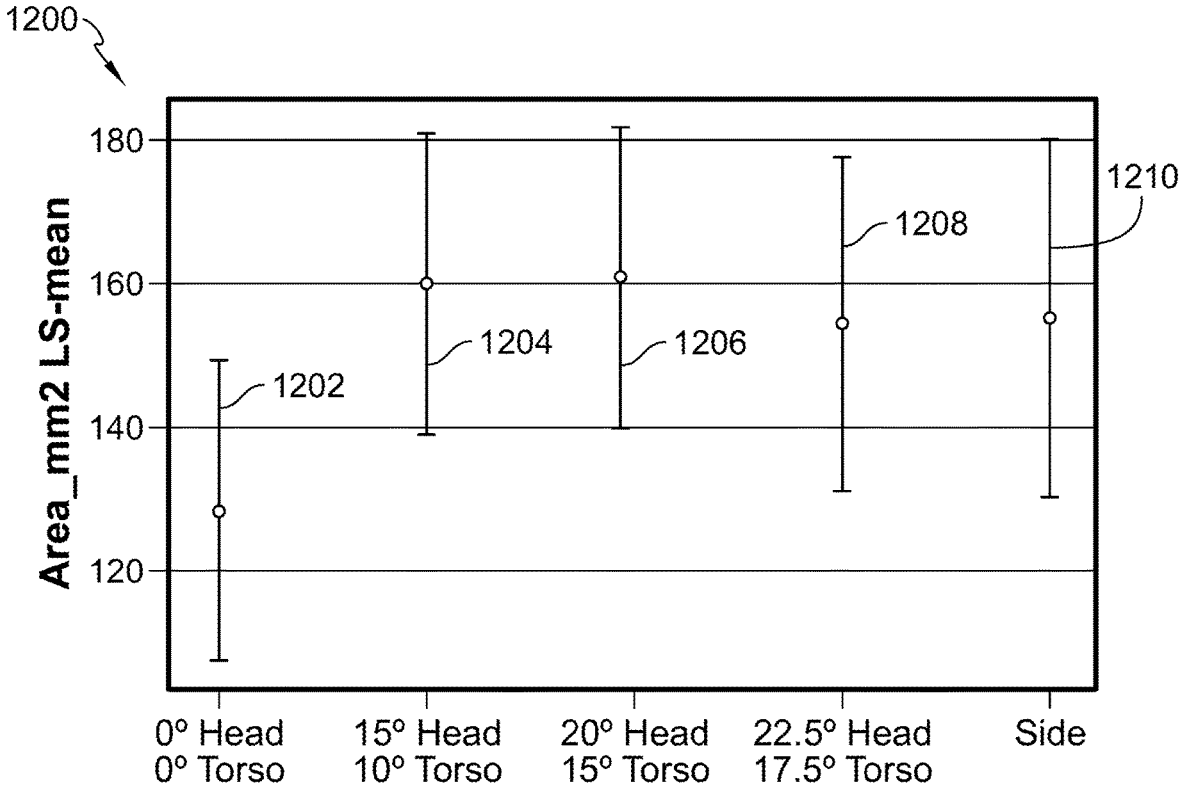
FIG. 18 is a graph of sleep surface orientations versus a minimum airway area taken in a retroglossal region of a user positioned on the sleep surface.

Referring to FIG. 18, the graph 1200 illustrates sleep orientations on the x-axis versus a minimum airway area on the y-axis taken in the retroglossal region of a user positioned on the sleep surface 114. As illustrated by line 1202, the minimum airway area in the retroglossal region for a user in the supine position with the head at 0° with respect to the horizontal support plane 124 and the torso at 0° with respect to the horizontal support plane 124 is between approximately 105 $mm^2$ and approximately 150 $mm^2$ with a mean minimum airway area in the retroglossal region of approximately 130 $mm^2$. As illustrated by line 1204, the minimum airway area in the retroglossal region for a user with the lateral rotation apparatus rotating the head at 15° with respect to the horizontal support plane 124 and rotating the torso at 10° with respect to the horizontal support plane 124 is between approximately 140 $mm^2$ and approximately 180 $mm^2$ with a mean minimum airway area in the retroglossal region of approximately 160 $mm^2$. As illustrated by line 1206, the minimum airway area in the retroglossal region for a user with the lateral rotation apparatus rotating the head at 20° with respect to the horizontal support plane 124 and rotating the torso at 15° with respect to the horizontal support plane 124 is between approximately 140 $mm^2$ and approximately 185 $mm^2$ with a mean minimum airway area in the retroglossal region of approximately 185 $mm^2$. As illustrated by line 1208, the minimum airway area in the retroglossal region for a user with the lateral rotation apparatus rotating the head at 22.5° with respect to the horizontal support plane 124 and rotating the torso at 17.5° with respect to the horizontal support plane 124 is between approximately 130 $mm^2$ and approximately 175 $mm^2$ with a mean minimum airway area in the retroglossal region of approximately 155 $mm^2$. As illustrated by line 1210, the minimum airway area in the retroglossal region for a user lying on their side is between approximately 130 $mm^2$ and approximately 180 $mm^2$ with a mean minimum airway area in the retroglossal region of approximately 155 $mm^2$. In all positions on the lateral rotation apparatus 200, the user has a greater average sagittal distance when compared to lying supine. For example, the user of the sleep surface 114 has a 24.6% greater mean minimum airway area than lying supine when lying with the head at 15° with respect to the horizontal support plane 124 and the torso at 10° with respect to the horizontal support plane 124 or when lying with the head at 20° with respect to the horizontal support plane 124 and the torso at 15° with respect to the horizontal support plane 124.

Figure 19:
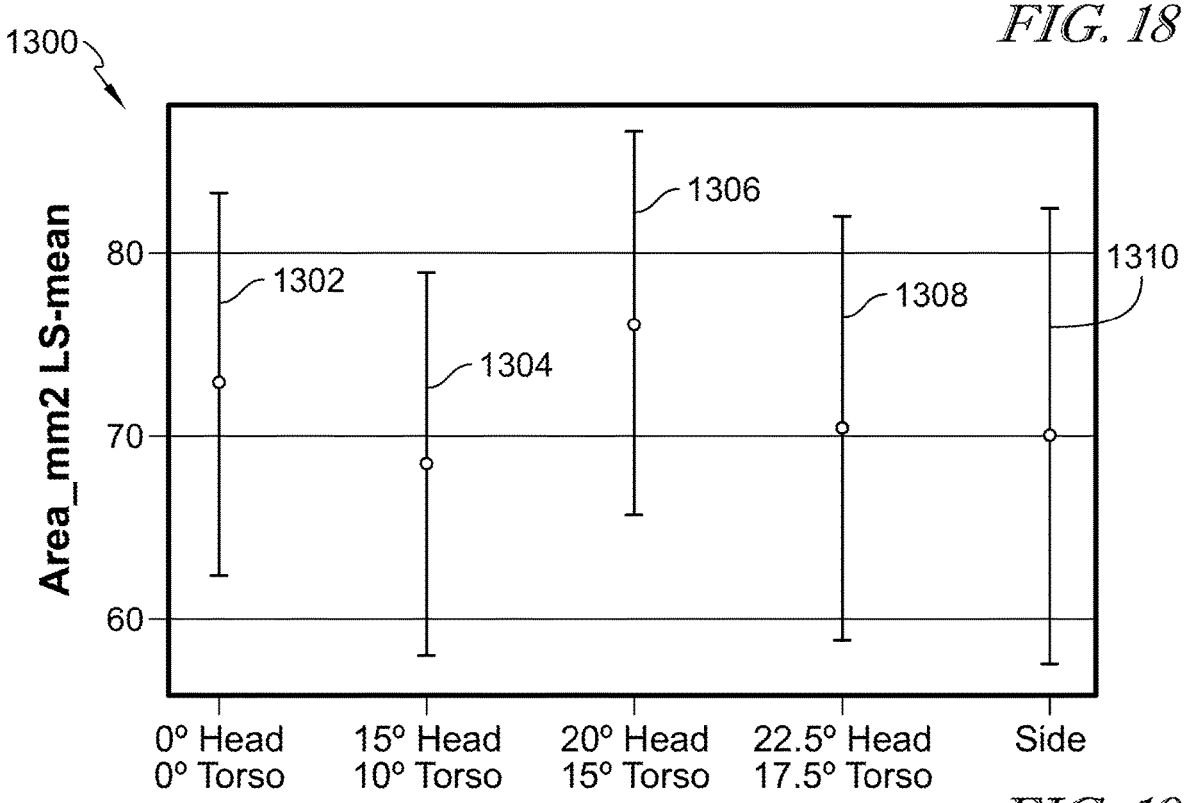
FIG. 19 is a graph of sleep surface orientations versus a minimum airway area taken in a retropalatal region of a user positioned on the sleep surface.

Referring to FIG. 19, the graph 1300 illustrates sleep orientations on the x-axis versus a minimum airway area on the y-axis taken in the retropalatal region of a user positioned on the sleep surface 114. As illustrated by line 1302, the minimum airway area in the retropalatal region for a user in the supine position with the head at 0° with respect to the horizontal support plane 124 and the torso at 0° with respect to the horizontal support plane 124 is between approximately 62.5 $mm^2$ and approximately 85 $mm^2$ with a mean minimum airway area in the retropalatal region of approximately 72.5 $mm^2$. As illustrated by line 1304, the minimum airway area in the retropalatal region for a user with the lateral rotation apparatus rotating the head at 15° with respect to the horizontal support plane 124 and rotating the torso at 10° with respect to the horizontal support plane 124 is between approximately 57.5 $mm^2$ and approximately 77.5 $mm^2$ with a mean minimum airway area in the retropalatal region of approximately 67.5 $mm^2$. As illustrated by line 1306, the minimum airway area in the retropalatal region for a user with the lateral rotation apparatus rotating the head at 20° with respect to the horizontal support plane 124 and rotating the torso at 15° with respect to the horizontal support plane 124 is between approximately 65 $mm^2$ and approximately 87.5 $mm^2$ with a mean minimum airway area in the retropalatal region of approximately 75 $mm^2$. As illustrated by line 1308, the minimum airway area in the retropalatal region for a user with the lateral rotation apparatus rotating the head at 22.5° with respect to the horizontal support plane 124 and rotating the torso at 17.5° with respect to the horizontal support plane 124 is between approximately 57.5 $mm^2$ and approximately 82.5 $mm^2$ with a mean minimum airway area in the retropalatal region of approximately 70 $mm^2$. As illustrated by line 1310, the minimum airway area for a user lying on their side is between approximately 55 $mm^2$ and approximately 82.5 $mm^2$ with a mean minimum airway area in the retropalatal region of approximately 70 $mm^2$. The user of the sleep surface 114 has a greater mean minimum airway area in the retropalatal region than lying supine when lying with the head at 20° with respect to the horizontal support plane 124 and the torso at 15° with respect to the horizontal support plane 124.

Figure 20A:
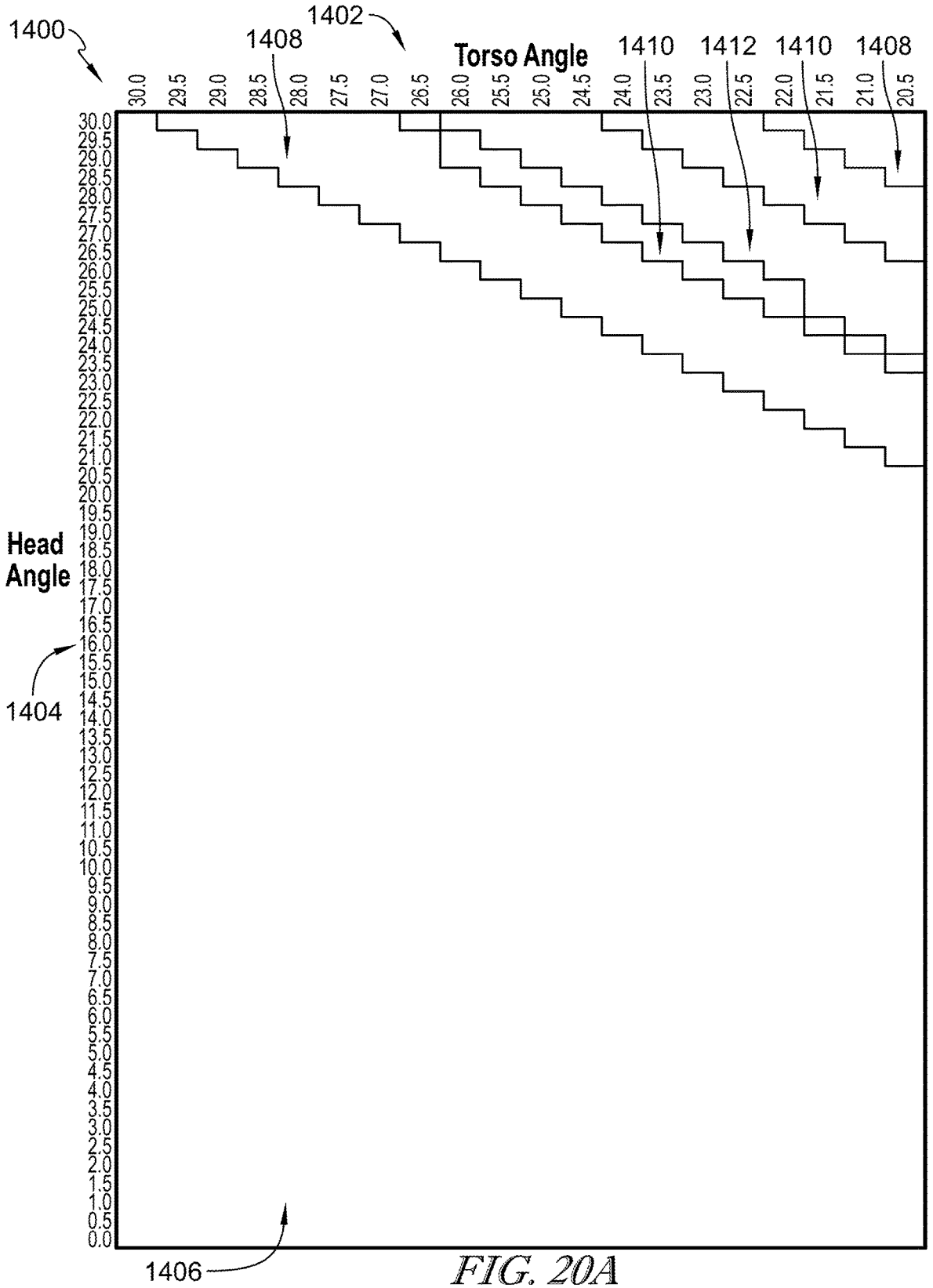
FIGS. 20A-20C illustrate an exemplary matrix of torso angles versus head angles that may be used to improve POSA and reduce the number of Apnea-Hypopnea Index events.
Figure 20B:
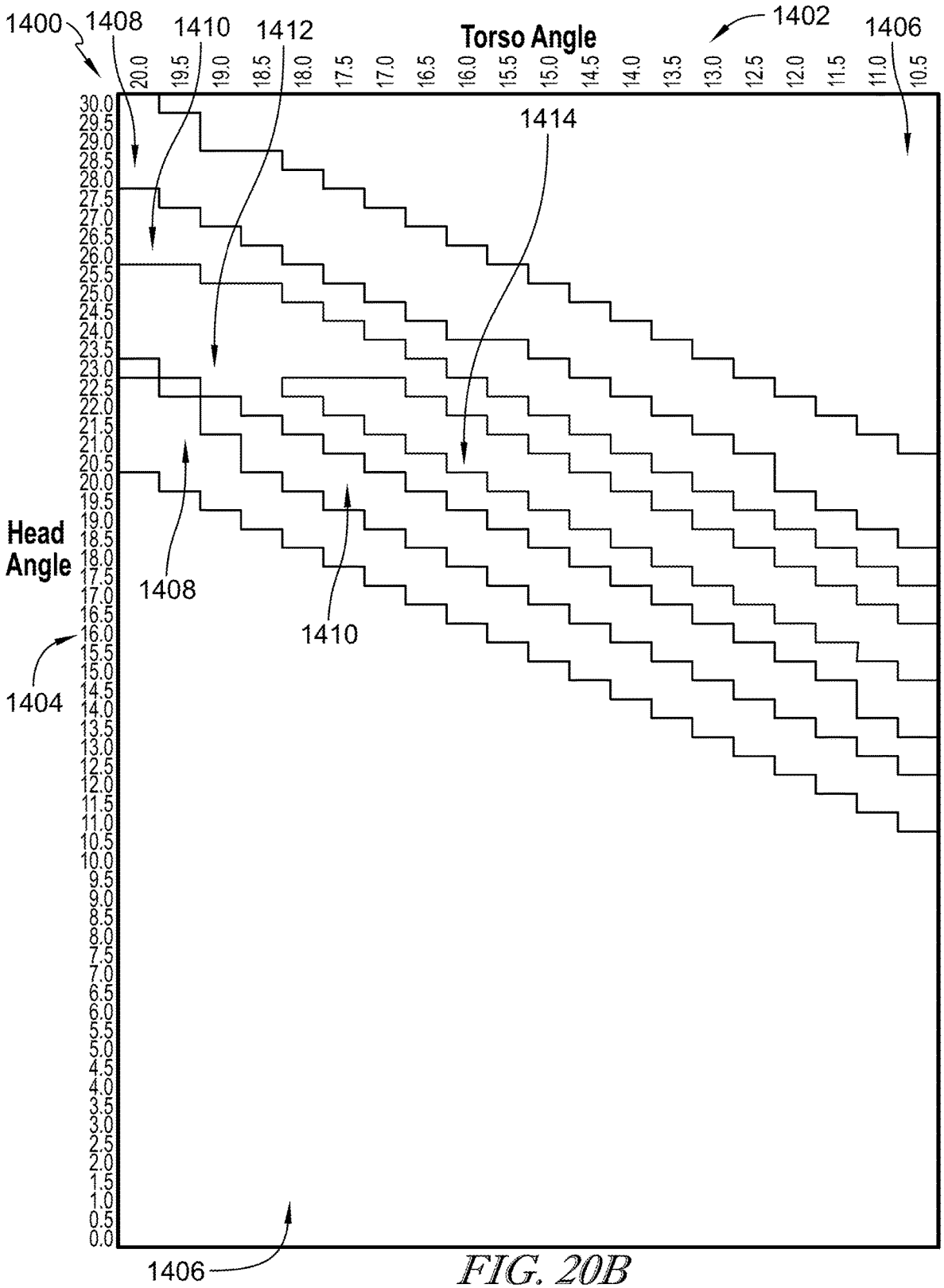
Figure 20C:
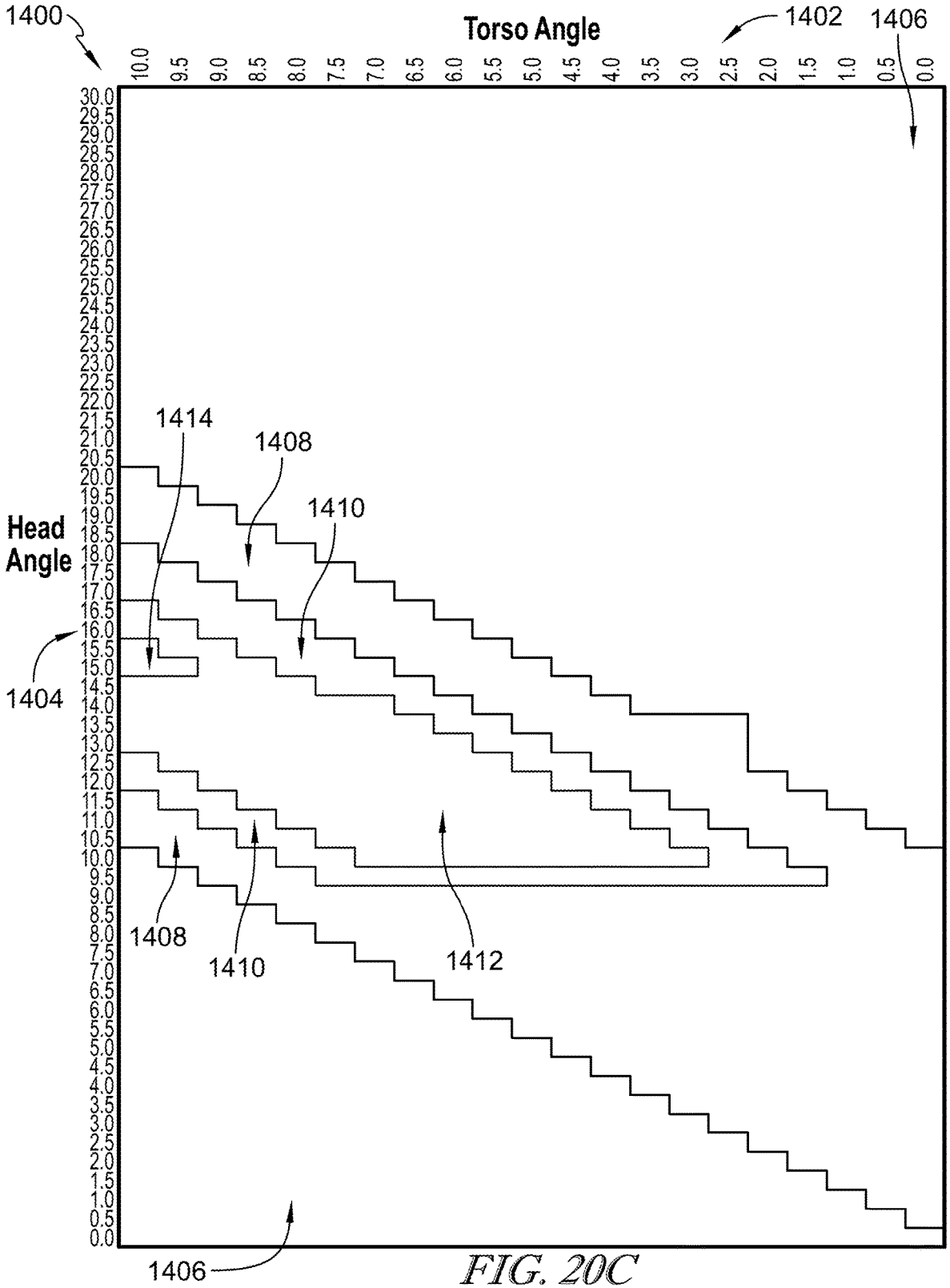

FIGS. 20A-20C illustrate an exemplary matrix 1400 of torso angles 1402 versus head angles 1404 that may be used to improve POSA and reduce the number of Apnea-Hypopnea Index events. The area 1406 illustrates combinations of torso angles 1402 and head angles 1404 that are generally considered unacceptable for improving POSA and reducing the number of Apnea-Hypopnea Index events. The area 1408 illustrates combinations of torso angles 1402 and head angles 1404 that are generally considered suboptimal for improving POSA and reducing the number of Apnea-Hypopnea Index events. The area 1410 illustrates combinations of torso angles 1402 and head angles 1404 that are generally considered good or fair for improving POSA and reducing the number of Apnea-Hypopnea Index events. The area 1412 illustrates combinations of torso angles 1402 and head angles 1404 that are generally considered very good for improving POSA and reducing the number of Apnea-Hypopnea Index events. The area 1414 illustrates combinations of torso angles 1402 and head angles 1404 that are generally considered excellent for improving POSA and reducing the number of Apnea-Hypopnea Index events.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

The invention claimed is:

1. A lateral rotation apparatus, comprising:

a person support surface comprising head, torso and leg segments each having an independently rotatable person support plane;

a first adjustable frame positioned below the head segment and operable to rotate the head segment of the person support surface to a head tilt angle, the first adjustable frame comprising:

an upper frame, a lower frame, and a linkage assembly connecting the upper frame of the first adjustable frame to the lower frame of the first adjustable frame, the linkage assembly of the first adjustable frame comprising a first link and a second link positioned in a crossed configuration, wherein the first link and the second link are operable to rotate the upper frame of the first adjustable frame with respect to the lower frame of the first adjustable frame such that the upper frame of the first adjustable frame is angled with respect to the lower frame of the first adjustable frame to provide a head tilt angle approximately at a centerline of the head segment that is in the range of about 7 to about 30 degrees relative to a horizontal support plane, wherein a lower end of the second link moves toward a lower end of the first link when the upper frame of the first adjustable frame is rotated with respect to the lower frame of the first adjustable frame; and a second adjustable frame positioned below the torso segment and operable to rotate the torso segment of the person support surface to a torso tilt angle, the second adjustable frame comprising:

an upper frame, a lower frame, and a linkage assembly connecting the upper frame of the second adjustable frame to the lower frame of the second adjustable frame, the linkage assembly of the second adjustable frame comprising a third link and a fourth link positioned in a crossed configuration, wherein the third link and the fourth link are operable to rotate the upper frame of the second adjustable frame with respect to the lower frame of the second adjustable frame such that the upper frame of the second adjustable frame is angled with respect to the lower frame of the second adjustable frame to provide a torso tilt angle approximately at a centerline of the torso segment that is in the range of about 5 to about 10 degrees less than the head tilt angle, wherein a lower end of the fourth link moves toward a lower end of the third link when the upper frame of the second adjustable frame is rotated with respect to the lower frame of the second adjustable frame, wherein the first adjustable frame and the second adjustable frame provide a graduated lateral rotation of the person support surface, and wherein the first adjustable frame and the second adjustable frame are not connected.

2. The lateral rotation apparatus of claim 1, wherein the upper frame of the first adjustable frame and the upper frame of the second adjustable frame are in contact with the person support surface.

3. The lateral rotation apparatus of claim 1, further comprising a jack coupled to the upper frame and lower frame of the first adjustable frame and operable to actuate the linkage assembly of the first adjustable frame.

4. The lateral rotation apparatus of claim 3, wherein the jack comprises a lock to maintain a rotational angle of the upper frame of the first adjustable frame with respect to the lower frame of the first adjustable frame.

5. The lateral rotation apparatus of claim 1, further comprising a jack coupled to the upper frame and lower frame of the second adjustable frame and operable to actuate the linkage assembly of the second adjustable frame.

6. The lateral rotation apparatus of claim 5, wherein the jack comprises a lock to maintain a rotational angle of the upper frame of the second adjustable frame with respect to the lower frame of the second adjustable frame.

7. The lateral rotation apparatus of claim 1, further comprising an actuator connecting the upper frame of the first adjustable frame to the lower frame of the first adjustable frame, the actuator actuating the linkage assembly of the first adjustable frame.

8. The lateral rotation apparatus of claim 7, wherein the actuator further comprises an electromechanical device.

9. The lateral rotation apparatus of claim 1, further comprising an actuator connecting the upper frame of the second adjustable frame to the lower frame of the second adjustable frame, the actuator actuating the linkage assembly of the second adjustable frame.

10. The lateral rotation apparatus of claim 9, wherein the actuator further comprises an electromechanical device.

11. The lateral rotation apparatus of claim 1, wherein the torso segment is rotated to a torso tilt angle approximately at a centerline of the torso segment in the range of about zero to about 25 degrees.

12. The lateral rotation apparatus of claim 1, wherein the head segment is rotated to a head tilt angle approximately at a centerline of the head segment in the range of about 10 to about 15 degrees.

13. The lateral rotation apparatus of claim 12, wherein the torso segment is rotated to a torso tilt angle approximately at a centerline of the torso segment in the range of about 5 to about 10 degrees.

14. The lateral rotation apparatus of claim 1, further comprising a third adjustable frame positioned below the leg segment and operable to rotate the leg segment to a leg tilt angle approximately at a centerline of the leg segment in the range of about 0 to about 5 degrees.

* * * * *